US012630383B2

(12) United States Patent
Makino et al.

(10) Patent No.: US 12,630,383 B2
(45) Date of Patent: May 19, 2026

(54) AUTOMATED GUIDED VEHICLE AND MANUFACTURING SYSTEM

(71) Applicant: Murata Manufacturing Co., Ltd., Nagaokakyo (JP)

(72) Inventors: Hiroaki Makino, Nagaokakyo (JP); Atsushi Oono, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 55 days.

(21) Appl. No.: 18/735,425

(22) Filed: Jun. 6, 2024

(65) Prior Publication Data

US 2024/0409348 A1 Dec. 12, 2024

(30) Foreign Application Priority Data

Jun. 7, 2023 (JP) ..... 2023-094347

(51) Int. Cl.
*B60Q 1/02* (2006.01)
*B65H 19/12* (2006.01)
*B65H 75/42* (2006.01)

(52) U.S. Cl.
CPC ..... *B65H 19/12* (2013.01); *B65H 75/425* (2013.01)

(58) Field of Classification Search
CPC ..... B65H 19/12; B65H 19/30; B65H 75/425; B65H 2553/42; B60Q 1/02
See application file for complete search history.

(56) References Cited

U.S. PATENT DOCUMENTS

| | | | | |
|---|---|---|---|---|
| 5,833,168 | A | 11/1998 | Tahata et al. | |
| 5,934,604 | A * | 8/1999 | Klimek | B65H 19/126 242/558 |
| 6,264,417 | B1 * | 7/2001 | Salsburg | B66F 3/22 414/610 |
| 7,008,164 | B2 * | 3/2006 | Rokkaku | B65G 69/24 198/370.09 |
| 11,292,703 | B2 * | 4/2022 | Ruhland | B65H 19/12 |
| 2021/0131065 | A1 * | 5/2021 | Myers | B60T 8/321 |

FOREIGN PATENT DOCUMENTS

| | | | |
|---|---|---|---|
| JP | H06278920 | A | 10/1994 |
| JP | H0764633 | B2 | 7/1995 |
| JP | H10203695 | A | 8/1998 |
| JP | 2001060111 | A | 3/2001 |
| JP | 2004-091007 | A | 3/2004 |
| JP | 2008090575 | A | 4/2008 |
| WO | 2019176278 | A1 | 9/2019 |

* cited by examiner

*Primary Examiner* — Sang K Kim
(74) *Attorney, Agent, or Firm* — Keating & Bennett, LLP

(57) ABSTRACT

An automated guided vehicle includes a roll holder to hold a roll, a detector to acquire information on a roll holder passage region, including positions through which the roll holder passes when the automated guided vehicle travels, an illuminator to emit illumination light towards the roll holder passage region, and a traveler to travel and support the roll holder, the detector, and the illuminator.

21 Claims, 22 Drawing Sheets

AUTOMATED GUIDED VEHICLE AND MANUFACTURING SYSTEM

CROSS REFERENCE TO RELATED APPLICATIONS

This application claims the benefit of priority to Japanese Patent Application No. 2023-094347 filed on Jun. 7, 2023. The entire contents of this application are hereby incorporated herein by reference.

BACKGROUND OF THE INVENTION

1. Field of the Invention

The present invention relates to automated guided vehicles and manufacturing systems.

2. Description of the Related Art

Conventionally, an automated guided vehicle is known, which includes a roll holder for holding a roll and a winding core holder for holding a winding core with an adhesive surface. For example, Japanese Unexamined Patent Application, Publication No. 2004-91007 discloses an automated guided vehicle that supplies a winding core to a sheet winding device and retrieves a roll from the sheet winding device.

In situations where a sheet is hanging from the roll that is set in the sheet winding device, if an automated guided vehicle enters the sheet winding device, part of the automated guided vehicle may contact and become entangled with the hanging sheet, potentially damaging the roll.

SUMMARY OF THE INVENTION

Example embodiments of the present invention provide automated guided vehicles each able to prevent situations where the roll gets damaged, for example, when the automated guided vehicles enter a sheet winding device.

An automated guided vehicle according to an example embodiment of the present invention includes a roll holder to hold a roll, a detector to acquire information on a roll holder passage region, including positions through which the roll holder passes when the automated guided vehicle travels, and an illuminator to emit illumination light towards the roll holder passage region.

An automated guided vehicle according to an example embodiment of the present invention includes a winding core holder to hold a winding core including an adhesive surface, a detector to acquire information on a winding core passage region, including positions through which the winding core held by the winding core holder passes when the automated guided vehicle travels, and an illuminator to emit illumination light towards the winding core passage region.

Example embodiments of the present invention provide automated guided vehicles and manufacturing systems each able to prevent situations where a roll gets damaged, for example, when the automated guided vehicle enters a sheet winding device.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Example embodiments of the present invention will be described in detail below with reference to the drawings.

Figure 1:
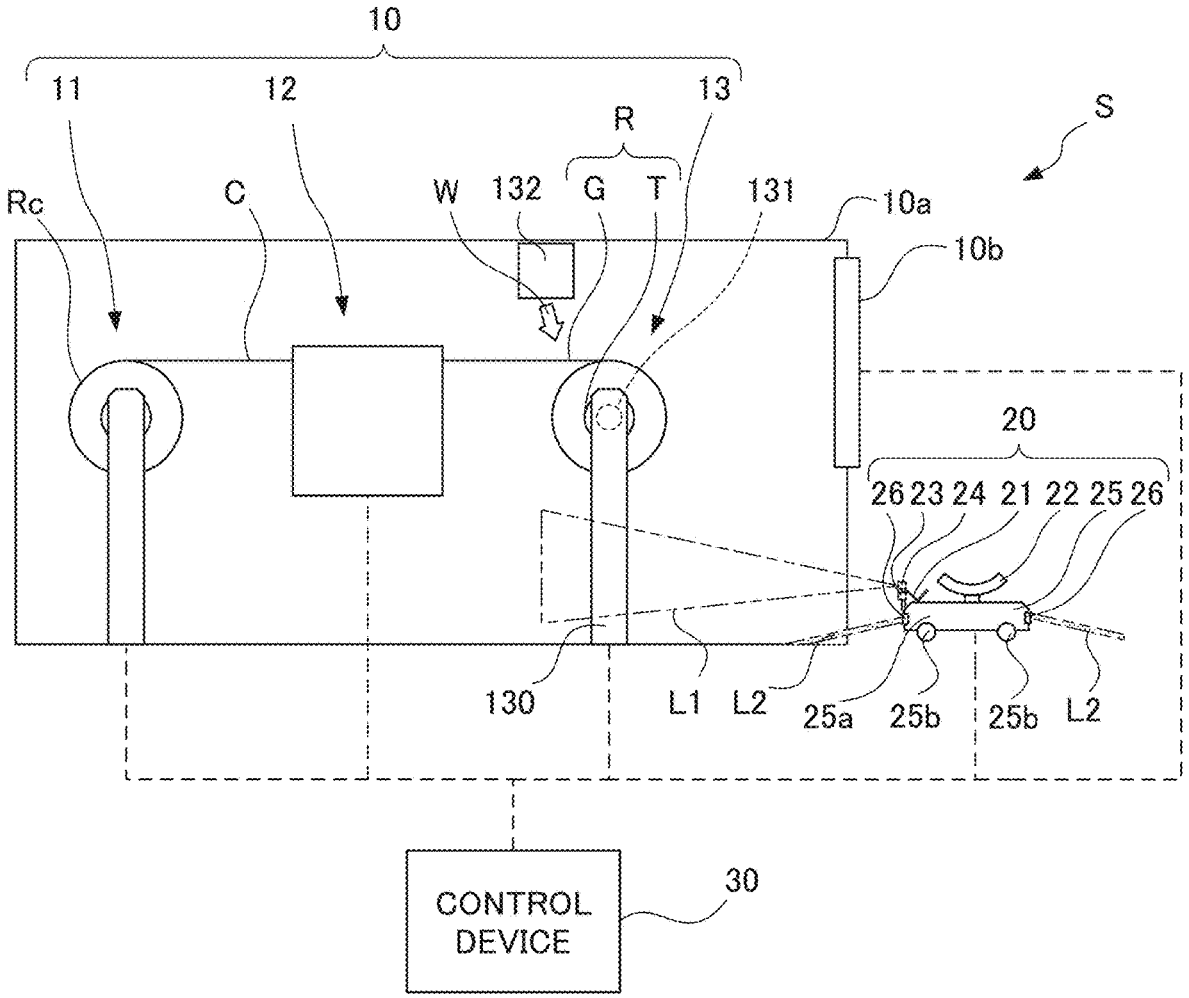
FIG. 1 is a schematic diagram illustrating a manufacturing system that includes an automated guided vehicle according to an example embodiment of the present invention.
Figure 2:
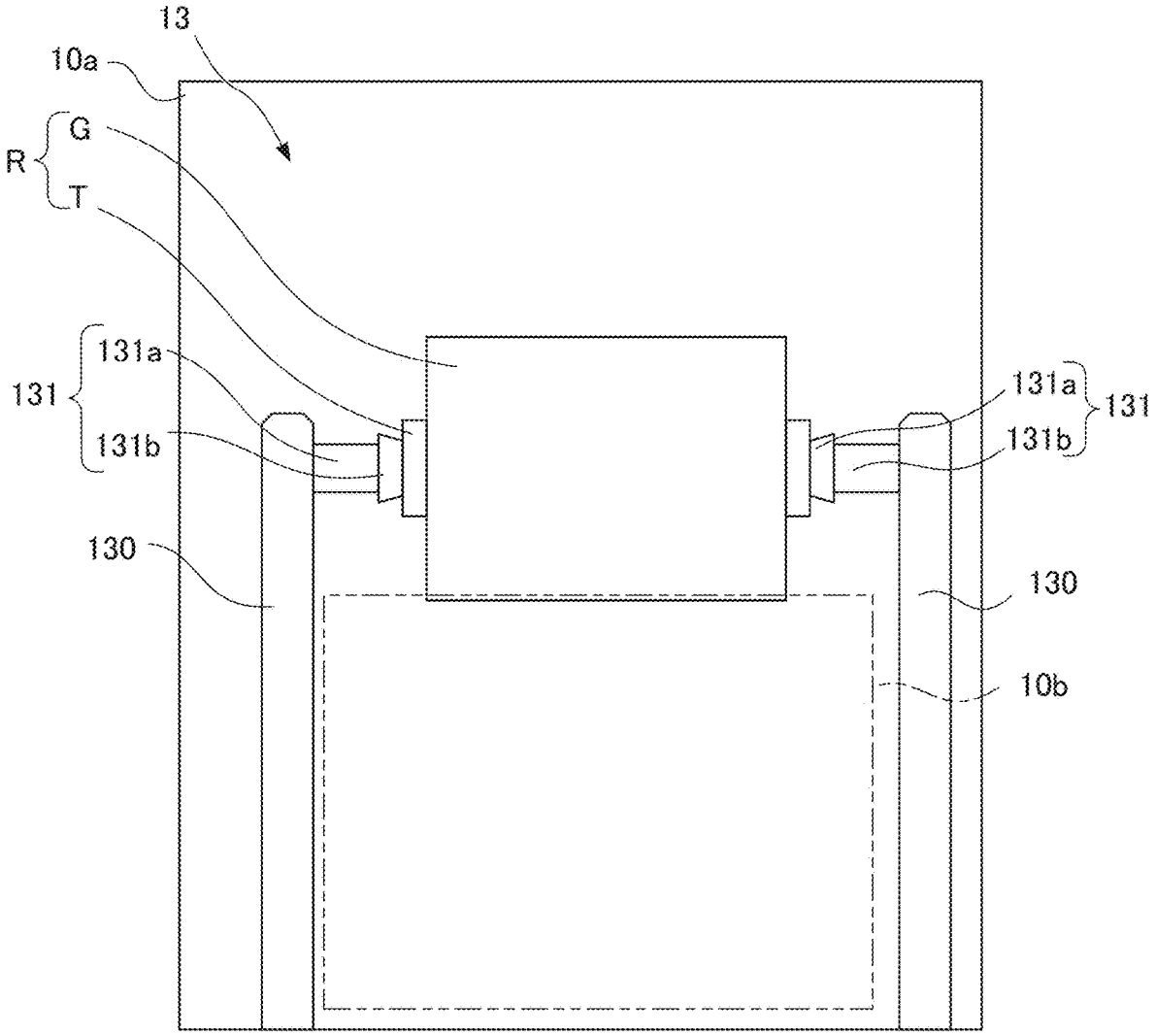
FIG. 2 is a schematic view of a winder of an example embodiment of the present invention, as viewed from the front (downstream side in the delivery direction).

Hereinafter, a manufacturing system S which includes an automated guided vehicle according to an example embodiment of the present invention will be described with reference to FIGS. 1 and 2. FIG. 1 is a schematic diagram illustrating the manufacturing system S including the automated guided vehicle according to an example embodiment of the present invention. FIG. 2 is a schematic diagram of the winder of the present example embodiment, as viewed from the front (downstream side in the delivery direction).

The manufacturing system S is designed to produce and deliver rolls R of a green sheet film G to subsequent processes. The green sheet film G is an intermediate product in the process of manufacturing multilayer ceramic electronic components. Examples of multilayer ceramic electronic components may include multilayer ceramic capacitors.

The manufacturing system S is not limited to handling the green sheet film G but can be applied to manufacturing systems that involve winding a sheet onto a winding core T to produce a roll R.

As illustrated in FIG. 1, the manufacturing system S includes a ceramic green sheet molding device 10, an automated guided vehicle 20, and a controller 30. The manufacturing system S includes, as the control device, an automated guided vehicle controller 27 described later of the automated guided vehicle 20, and the controller 30. Details are described below.

Ceramic Green Sheet Molding Device

The ceramic green sheet molding device 10 will be described using FIGS. 1 and 2. In the present example embodiment, the ceramic green sheet molding device 10 molds a ceramic green sheet on a carrier film C. In the following description, the carrier film C with the ceramic green sheet molded thereon is collectively referred to as the green sheet film G. The ceramic green sheet molding device 10 winds the green sheet film G as a sheet onto the winding core T to produce the roll R. That is, the roll R includes the green sheet film G as a sheet wound onto the winding core T.

Here, the winding core T is used to wind the green sheet film G. The winding core T is a cylindrical member including a hollow portion, into which a winding shaft described later is inserted. The winding core T includes an adhesive on the surface. Therefore, when winding the green sheet film G onto the winding core T, one end of the green sheet film G can easily be adhered to the winding core T. In the present example embodiment, the winding core T is, for example, a paper tube made of paper. However, the material of the winding core T is not limited to this, and may be made of, for example, plastic or metal.

As illustrated in FIG. 1, the ceramic green sheet molding device 10 includes an unwinder 11, a coater 12, and a winder 13 defining and functioning as a sheet winding device. The ceramic green sheet molding device 10 may include a housing 10*a*. The housing 10*a* covers the unwinder 11, the coater 12, and the winder 13, and is capable of protecting the molded green sheet film G from external environment such as external temperature variation and dust. The housing 10*a* includes an opening, through which the automated guided vehicle 20 delivering the manufactured rolls R can enter and exit, and the opening includes a shutter 10*b* as described later.

As illustrated in FIG. 1, the unwinder 11 unwinds the carrier film C from the upper side of the roll Rc towards the coater 12, and supplies the carrier film C to the coater 12. The carrier film C may be, for example, a translucent plastic film.

In the present example embodiment of the manufacturing system S, the unwinder 11 unwinds the carrier film C from the upper side of the roll Rc loaded with the carrier film C. However, this is not limited. For instance, the unwinder 11 may alternatively unwind the carrier film C from the lower side of the roll Rc loaded with the carrier film C. In the present example embodiment of the manufacturing system S, the rotational axis of the roll Rc in the unwinder 11 is set to rotate in conjunction with the winder 13 described later. However, the setting of the rotational axis of the roll Rc in the unwinder 11 is not limited thereto.

The coater 12 applies a slurry including a ceramic material onto the carrier film C, and molds the ceramic green sheet on the carrier film C. In the present example embodiment, the slurry including a ceramic material is applied onto the carrier film C using, for example, a doctor blade method. The green sheet film G, which includes the ceramic green sheet molded on the carrier film C by the coater 12, is dried in a drying section (not illustrated) and then delivered to the winder 13.

As illustrated in FIG. 1, the winder 13 winds the green sheet film G molded on the carrier film C from the upper side of the winding core T into a roll, thus manufacturing and retrieving the roll R. The winder 13 includes a pair of supports 130 and a pair of chucking devices 131. In the present example embodiment of the manufacturing system S, the winder 13 winds the green sheet film G from the upper side of the winding core T into a roll. However, this is not limited. For example, the winder 13 may wind the green sheet film G from the lower side of the winding core T into a roll.

As illustrated in FIGS. 1 and 2, the supports 130 are designed to support the chucking devices 131. The supports 130 are provided to extend upwards from the floor. However, the configuration of the supports 130 is not limited to this. For instance, whatever supports the chucking devices 131 may define the supports, or the supports may horizontally extend from the frame.

Figure 10:
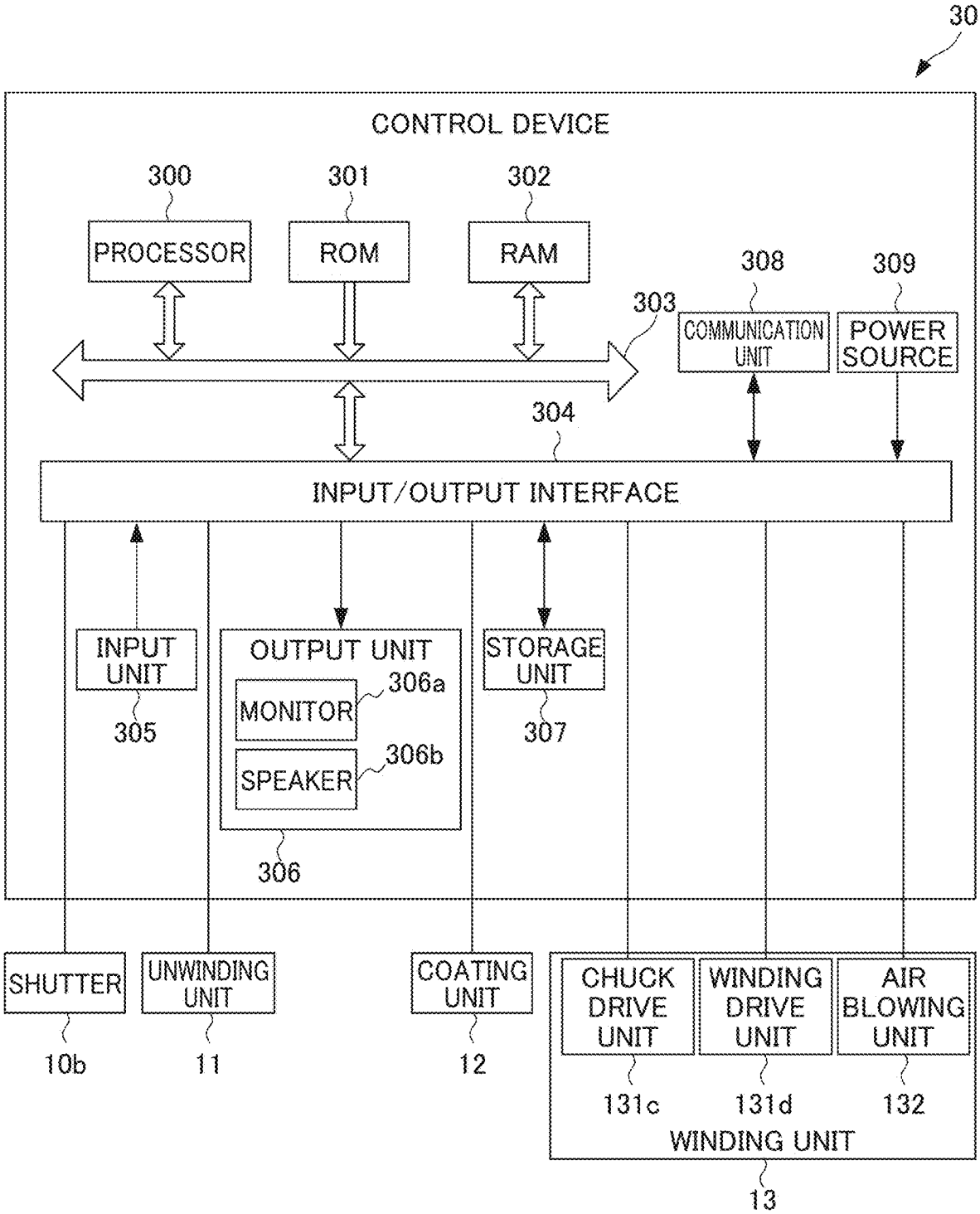
FIG. 10 is a block diagram illustrating the hardware configuration of a ceramic green sheet molding device according to an example embodiment of the present invention.

The chucking devices 131 are designed to rotatably hold the winding core T. For example, the chucking devices 131 according to the present example embodiment include a pair of winding shafts 131*a* as well as a pair of chucks 131*b* as illustrated in FIG. 2, a chuck driver 131*c* as illustrated in FIG. 10 described later, and a winding driver 131*d*.

The pair of winding shafts 131*a* are designed to chuck and rotate the winding core T. In the present example embodiment, the first one of the pair of winding shafts 131*a* is held by the support 130 so as to be slidable in the direction of the pair of supports 130 facing each other, and is driven by the chuck driver 131*c* to slide in the direction of the pair of winding shafts 131*a* facing each other. Not limited to this, both of the pair of winding shafts 131*a* may be slidable in the direction of facing each other, and is driven by the chuck driver 131*c* to slide in the direction of the pair of winding shafts 131*a* facing each other.

The chuck driver 131*c* may include, for example, an air cylinder or motor as a drive source. The second one of the pair of winding shafts 131*a* is fixed to the support 130. Thus, the first one of the pair of winding shafts 131*a* is driven by the chuck driver 131*c* to slide so as to narrow the distance between the pair of winding shafts 131*a*, to enable the pair of winding shafts 131*a* to move to the chucking position to chuck the winding core T. The first one of the pair of winding shafts 131*a* is driven by the chuck driver 131*c* to slide so as to widen the distance between the pair of winding shafts 131*a*, thus the pair of winding shafts 131*a* to move to the chuck releasing position to release the winding core T from chucking.

The pair of chucks 131*b* are designed to hold the winding core T. The chucks 131*b* are frustoconical members with the diameter decreasing towards one end in the central axis direction and increasing towards the other end. More specifically, one side of the chuck 131*b* in the central axis direction is smaller than the hollow portion of the winding core T. The other side of the chuck 131*b* in the central axis direction is larger than the hollow portion of the winding core T. The shape of the chuck 131*b* is not limited to this.

The other side of the chuck 131*b* is set at one end of the winding shaft 131*a*. Therefore, the one side of the chuck 131*b* can be inserted into the hollow portion of the winding core T, and the peripheral surface of the chuck 131*b* can be pressed against and fitted to the inner surface of the hollow portion. That is, the pair of chucks 131*b* are pushed from both sides by the pair of winding shafts 131*a* and can fit into the hollow portion of the winding core T, thus allowing for chucking the winding core T.

The first one of the pair of chucks 131*b* is rotatably held at one end of the first one of the pair of winding shafts 131*a*. The second one of the pair of chucks 131*b* is rotatably held at one end of the second one of the pair of winding shafts 131*a*, and rotates when driven by the winding driver 131*d*. The winding driver 131*d* may use a motor as the drive source, for example. In the present example embodiment, the winding driver 131*d* is provided only on the side of the second one of the pair of chucks 131*b*, which is not limited, and may be provided on both sides.

Thus, in the state where the winding core T is positioned between the pair of winding shafts 131*a*, such that the central axis of the winding shafts 131*a* aligns or substantially aligns with the central axis of the winding core T, the chucking device 131 moves the pair of winding shafts 131*a* to the chucking position, thus allowing chucking of the winding core T. While the winding core T is chucked, the chucking device 131 rotates the second one of the pair of chucks 131*b* when driven by the winding driver 131*d*, thus allowing for the winding operation.

Therefore, in the winder 13, the winding core T set in the chucking device 131 is rotationally driven by the winding driver 131*d*, thus winding the green sheet film G molded on the carrier film C around the winding core T to form the roll R.

The winder 13 of the manufacturing system S may include, for example, an air blower 132. For example, in the present example embodiment of the manufacturing system S, the air blower 132 is provided in the upper area near the winder 13 within the housing 10*a*.

In the present example embodiment, the air blower 132 is provided in the upper area near the winder 13 within the housing 10*a*, which is not limited. For instance, the air blower 132 may be provided on the automated guided vehicle 20.

Figure 5:
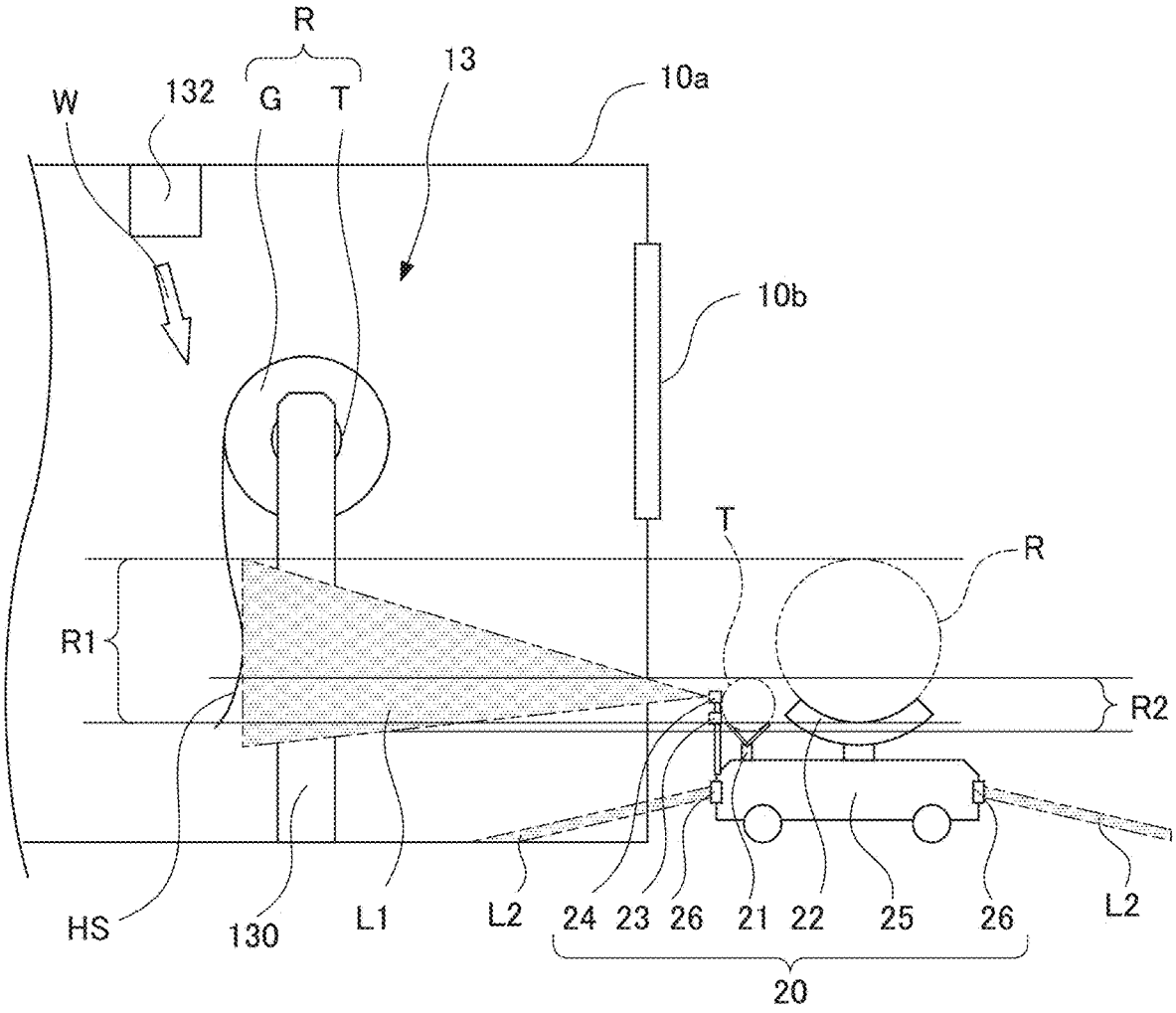
FIG. 5 is a schematic diagram illustrating a roll holder passage region and a winding core passage region according to an example embodiment of the present invention.

As illustrated in FIGS. 1 and 5, when a translucent film is hanging from the roll set in the winder 13, the air blower 132 blows air W such that the hanging translucent film will flutter. The air blower 132 may directly blow air onto the translucent film hanging from the roll R, or may blow air through another member.

The air blower 132 can blow air onto the green sheet film G hanging, efficiently causing the translucent film to flutter. This improves the efficiency for the detector to detect the translucent film.

As illustrated in FIGS. 1, 2, and 5, the winder 13 of the manufacturing system S may include a shutter 10*b* that blocks the entry of the automated guided vehicle 20. An example of the shutter 10*b* may include a door, rails that support the door to vertically slide, and a shutter driver that causes the door to vertically slide. The shutter 10*b* includes an opened state in which the door is slid up to the top to allow the entry of the automated guided vehicle, and a closed state in which the door is slid down to the bottom to block the entry of the automated guided vehicle 20.

Automated Guided Vehicle

Figure 3:
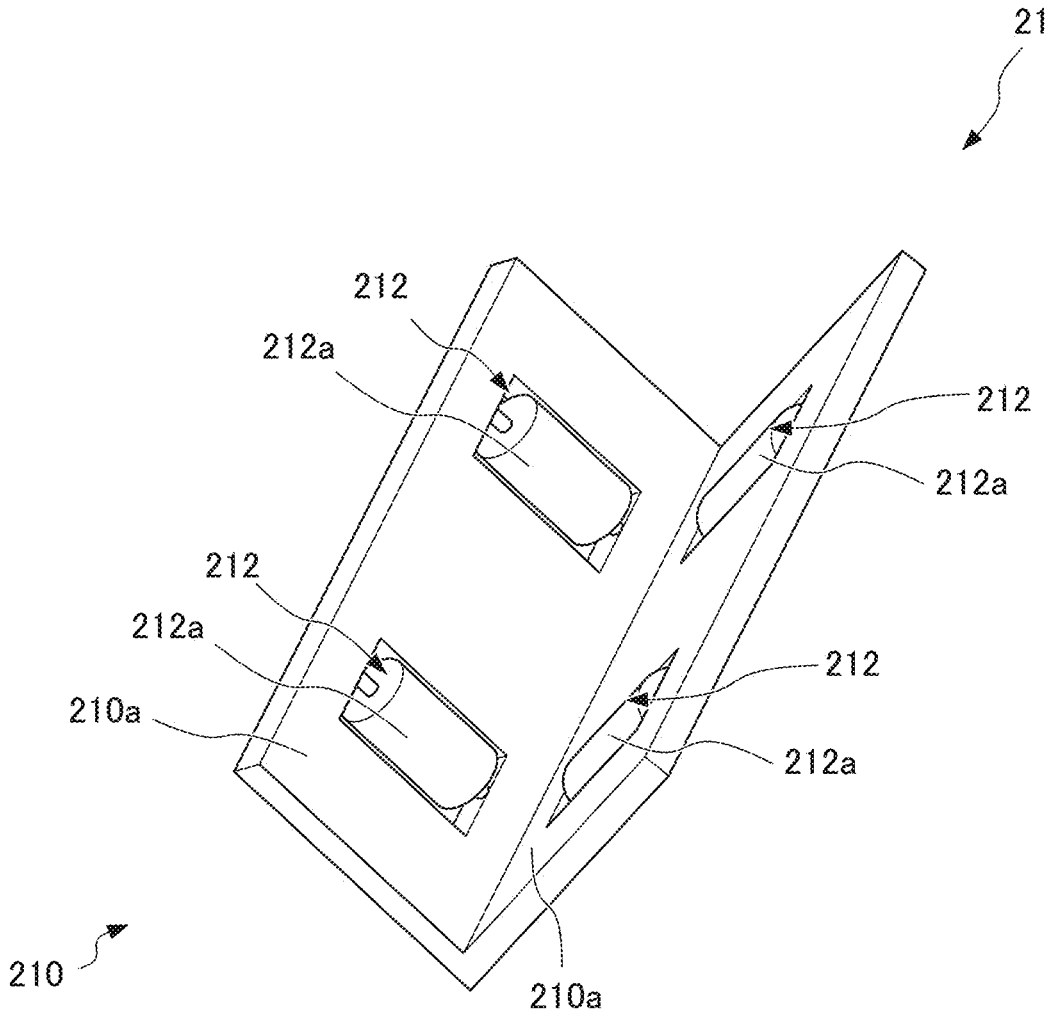
FIG. 3 is a birds-eye view of a holder main body of a winding core holder according to an example embodiment of the present invention.
Figure 4:
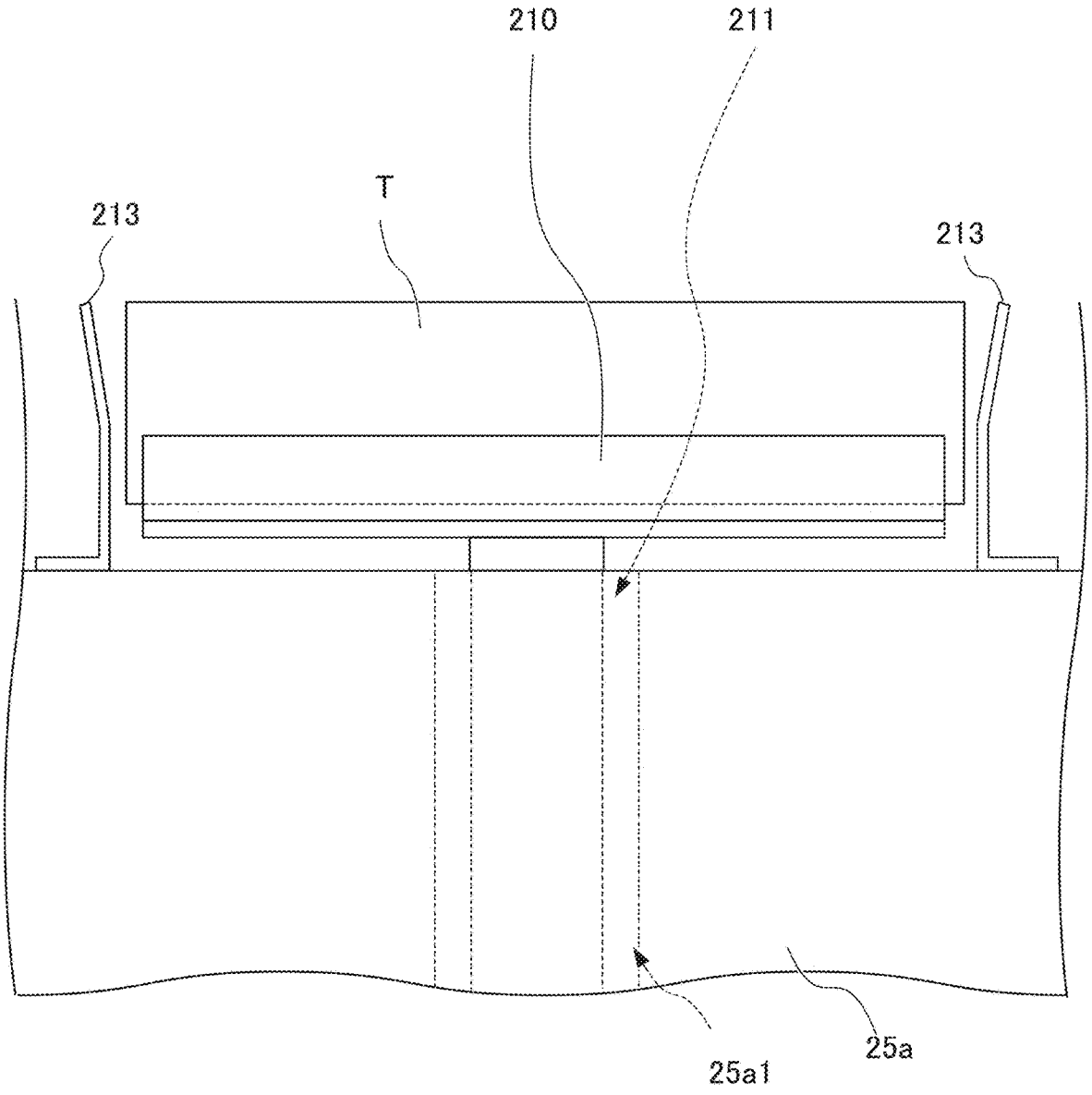
FIG. 4 is a schematic view of the winding core holder, as viewed from the front of the automated guided vehicle.
Figure 6:
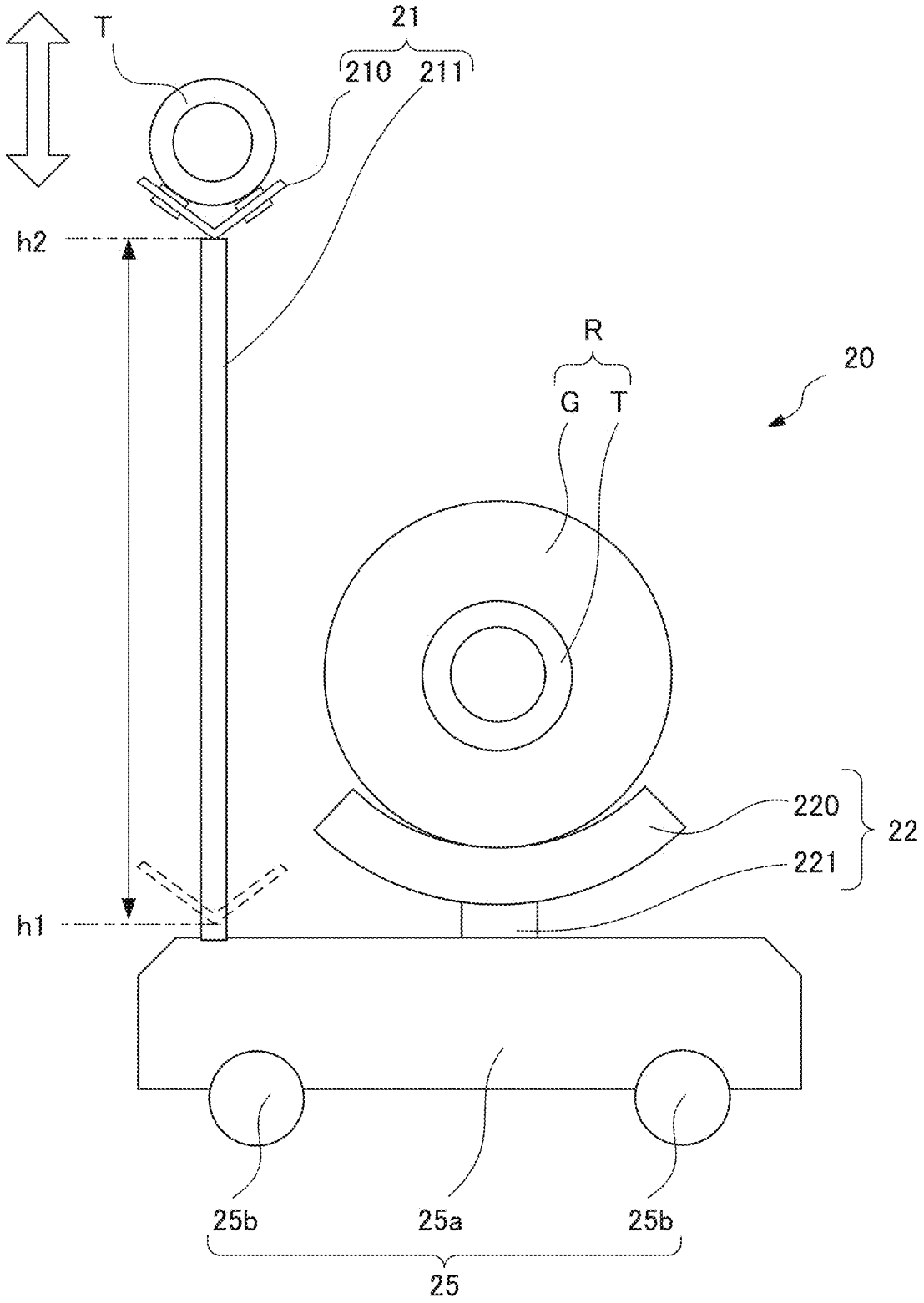
FIG. 6 is a schematic diagram illustrating the lifting operation of the winding core holder.
Figure 7:
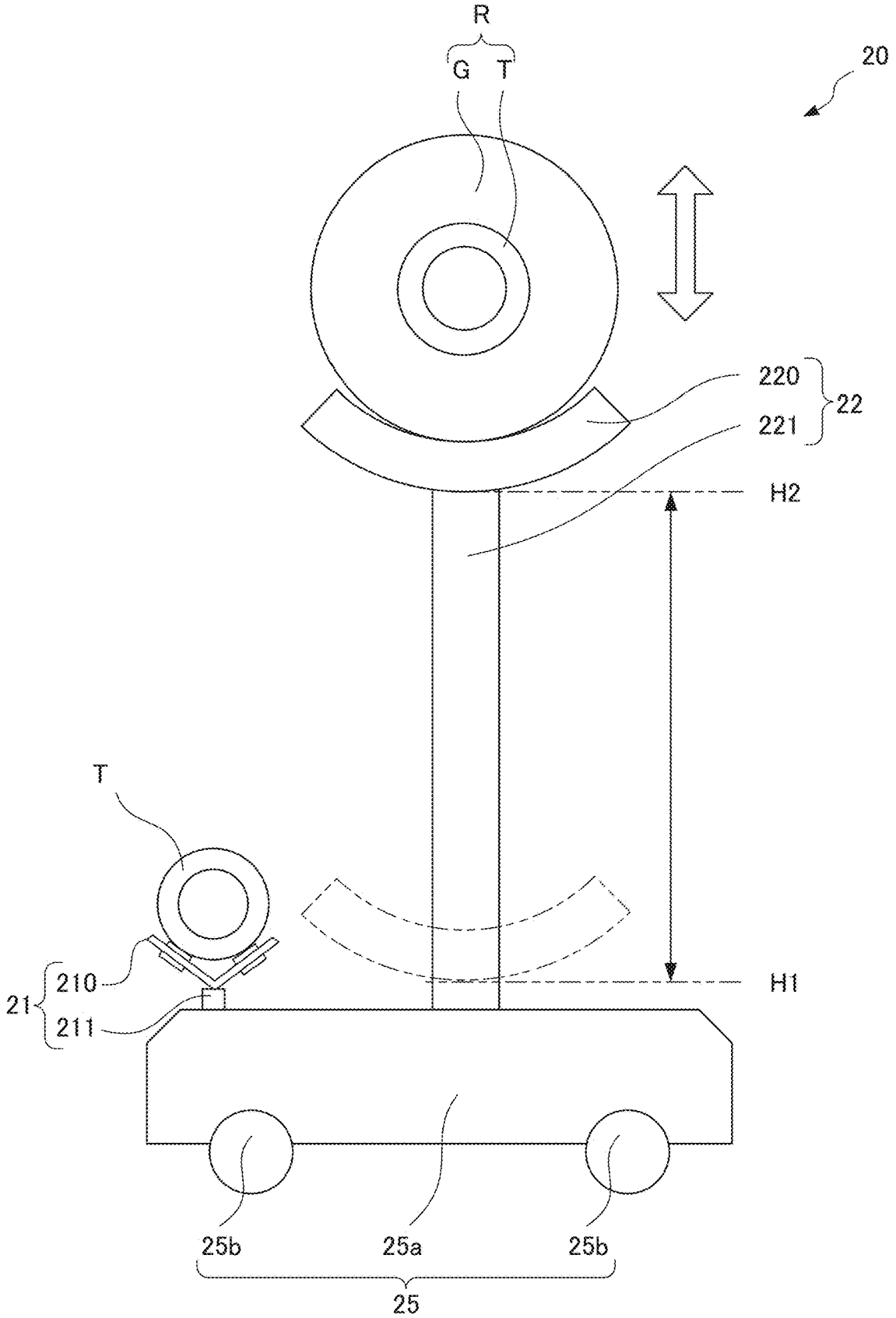
FIG. 7 is a schematic diagram illustrating the lifting operation of the roll holder.
Figure 8:
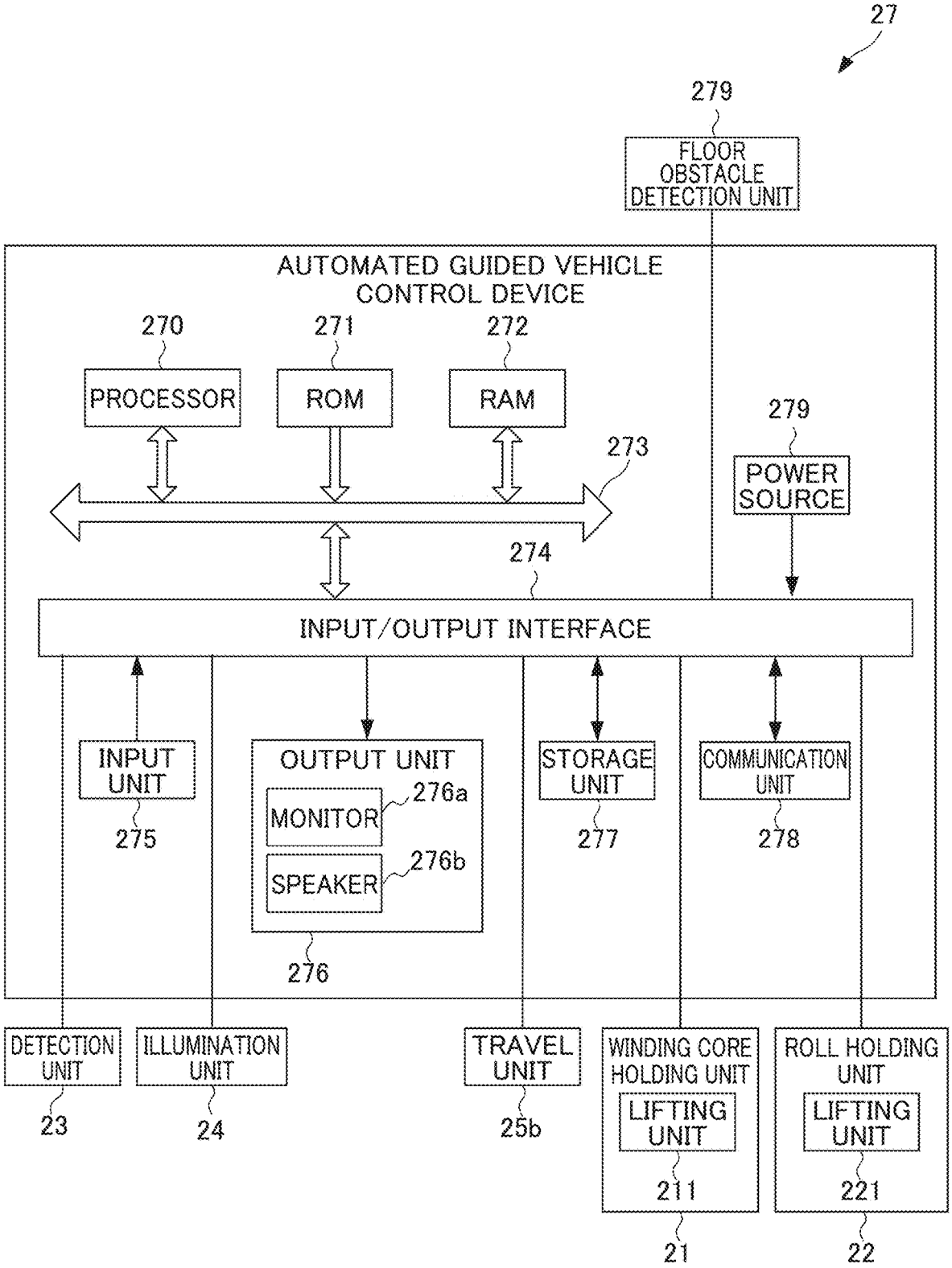
FIG. 8 is a block diagram illustrating the hardware configuration of an automated guided vehicle according to an example embodiment of the present invention.
Figure 9:
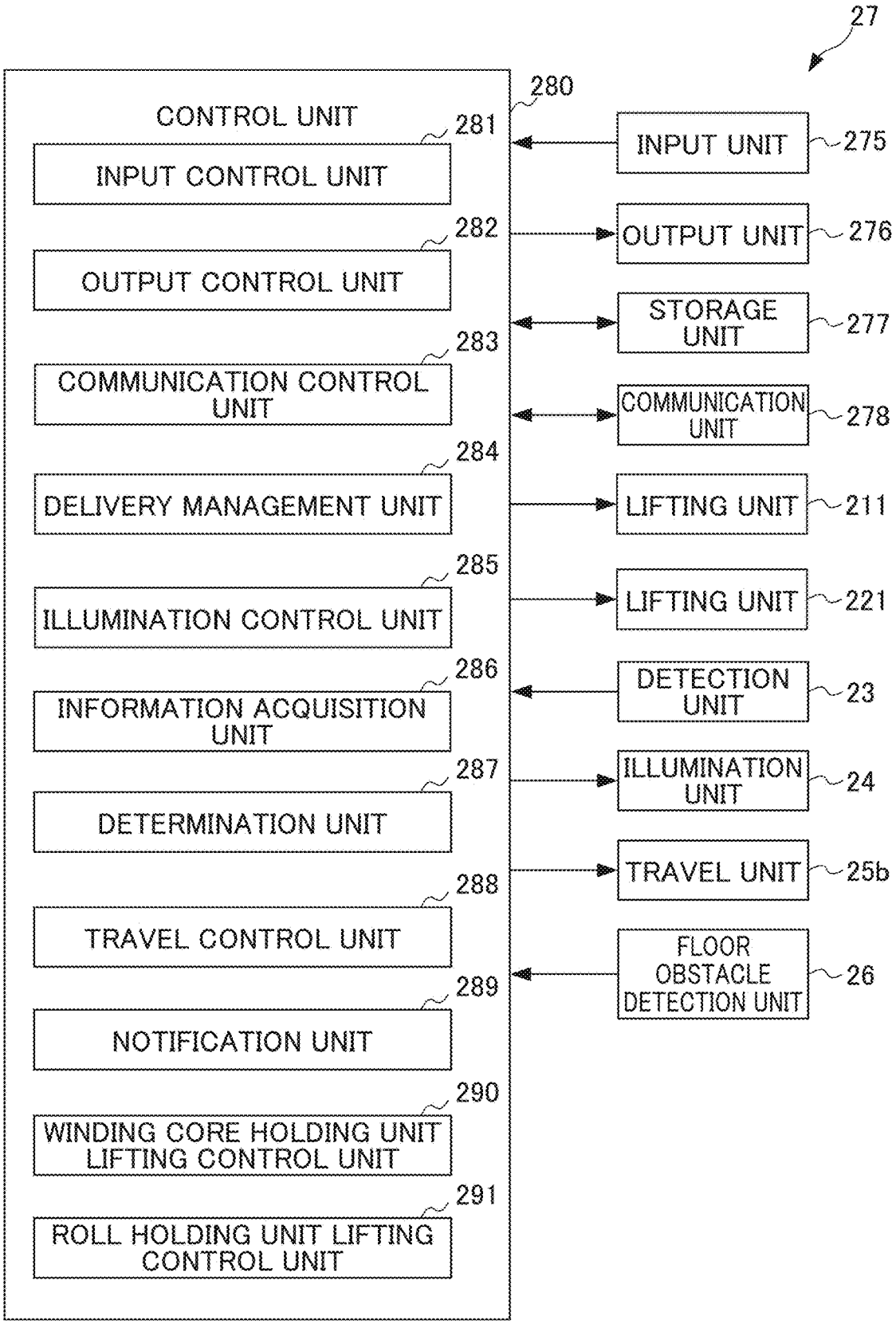
FIG. 9 is a block diagram illustrating the functional configuration of an automated guided vehicle controller according to an example embodiment of the present invention.

Next, the automated guided vehicle 20 is described using FIGS. 1, and 3 to 9. FIG. 3 is a birds-eye view of a holder main body 210 of a winding core holder 21 according to the present example embodiment. FIG. 4 is a schematic diagram of the winding core holder 21 of the automated guided vehicle 20, as viewed from the front. For simplicity in description, illustration of a roller 212 described later is omitted in FIG. 4. FIG. 5 is a schematic diagram illustrating the roll holder passage region R1 and the winding core passage region R2 according to the present example embodiment. FIG. 6 is a schematic diagram illustrating the lifting operation of the winding core holder 21. FIG. 7 is a schematic diagram illustrating the lifting operation of a roll holder 22. FIG. 8 is a block diagram illustrating the hardware configuration of the automated guided vehicle 20 according to the present example embodiment. FIG. 9 is a block diagram illustrating the functional configuration of an automated guided vehicle controller 27 according to the present example embodiment.

The automated guided vehicle 20 supplies the winding core T to the winder 13 defining and functioning as a sheet winding device, and retrieves the roll R from the winder 13. More specifically, the automated guided vehicle 20 delivers and supplies the winding core T to the chucking device 131 of the winder 13. The automated guided vehicle 20 also retrieves the roll R, which has been manufactured from the green sheet film G wound around the winding core T, from the winder 13, and delivers the retrieved roll R to a designated location.

The automated guided vehicle 20 according to the present example embodiment, for example, travels along pre-laid rails along a predetermined route defined as the travel route of the automated guided vehicle 20. The automated guided vehicle 20 may store travel route information in a storage 277 described later, acquire the own position information, and travel along the predetermined route based on the travel route information and the acquired position information.

As illustrated in FIGS. 1, and 3 to 9, the automated guided vehicle 20 includes a winding core holder 21 that holds the winding core T, a roll holder 22 that holds the roll, a stopper 213 defining and functioning as a movement restrictor to restrict movement of the winding core in the winding core axial direction, a detector 23, an illuminator 24, a vehicle body 25, a floor obstacle detector 26, and the automated guided vehicle controller 27 as illustrated in FIG. 8. For convenience of description, illustration of the stopper 213 is omitted, except for FIG. 4.

Winding Core Holder

As illustrated in FIGS. 3, and 6 to 9, the winding core holder 21 includes a lifter 211, a holder main body 210, and a roller 212 defining and functioning as a rolling device.

Lifter

As illustrated in FIGS. 4, and 6 to 9, the lifter 211 is designed to raise and lower the holder main body 210. For example, the lifter 211 of the present example embodiment includes a hydraulic mechanism (not illustrated) and a winding core lifter that can be raised and lowered by the hydraulic mechanism. The winding core lifter is telescopically provided within a hollow portion 25*al* of a trolley 25*a*, which will be described later, of the vehicle body 25. The winding core lifter may include a known telescopic mechanism such as telescopic pipes or a multi-joint link mechanism, and the winding core lifter is designed to extend during raising and to contract during lowering. That is, the winding core lifter is raised or lowered when extended or retracted by the hydraulic mechanism. The drive source for the lifting mechanism is not limited to the hydraulic mechanism. An example of the drive source may be an electric motor.

Holder Main Body

The holder main body 210 to hold the winding core T. The holder main body 210 includes two surfaces that face the winding core T when the winding core T is placed on the roller 212. For example, as illustrated in FIG. 3, the holder main body 210 includes two inclined surfaces 210*a* that form a V-shape on the surfaces. In other words, the two surfaces 210*a* are inclined so as to diverge upwards.

The holder main body 210 may be, for example, made of stainless steel. However, the material of the holder main body 210 is not limited to stainless steel. The holder main body 210 is preferably made from a material with rigidity, and is preferably made from metal. In this case, the surface of the holder main body 210 is metallic. The surface of the holder main body 210 may include, for example, rubber such as a urethane rubber sheet, placed over the surface made of metal such as stainless steel.

The holder main body 210 can be raised and lowered. For example, the holder main body 210 is held by the winding core lifter of the lifter 211, and raised or lowered when driven by the lifter 211. The lifter 211 position-controls the holder main body 210 between a lowered position h1 and a raised position h2. For instance, the lowered position h1 is the position of the holder main body 210 as illustrated in FIG. 6. The raised position h2 is the position of the holder main body 210 as illustrated in FIG. 6. The holder main body 210 may include detector, for example, such as proximity sensors or touch sensors, to detect whether the winding core T is held.

Roller

The roller 212 is designed to enable the winding core T to be movable in the winding core axial direction. The roller 212 is held to be rollable in relation to the holder main body 210. The roller 212 is axially supported in a direction intersecting the winding core axial direction. Therefore, the roller 212 can enable the winding core T to be movable in the axial direction of the winding core T. The surface 212*a* of the roller 212 is defined by a high-release surface that has higher release properties than the surface 210*a* of the holder main body 210.

At least the surface 212*a* of the roller 212 may be made of a material including, for example, fluorine resin. For example, the roller 212 may be made of fluorine resin. Alternatively, electroless nickel plating including fluorine resin may be provided on the surface 212*a* of the roller 212. Alternatively, fluorine resin may be coated on the surface 212*a* of the roller 212. The surface 212*a* of the roller 212 may be subjected to a release surface treatment. For instance, the surface 212*a* of the roller 212 may be a release surface with a texture created by, for example, sandblasting or similar methods to reduce the contact area with the winding core T.

The winding core holder 21 includes at least four rollers 212. For example, the winding core holder 21 includes at least two rollers 212 on each of the two inclined surfaces of the holder main body 210. Although the present example embodiment uses cylindrical rollers as the rolling units, the rollers are not limited to cylindrical rollers. For example, spherical ball rollers may be used.

Stopper

The automated guided vehicle 20 further includes a stopper 213 defining and functioning as a movement restrictor. When the holder main body 210 of the winding core holder 21 is in the lowered position h1, the stopper 213 restricts movement of the winding core T in the winding core axial direction held by the holder main body 210 of the winding core holder 21. When the holder main body 210 of the winding core holder 21 is in the raised position h2, the stopper 213 exposes the ends of the winding core T held by the holder main body 210 of the winding core holder 21.

As illustrated in FIG. 4, the stopper 213 includes a pair of plate-shaped members provided on both ends of the holder main body 210 on the vehicle body 25 in the winding core axial direction. That is, the stopper 213 is fixed on the vehicle body 25. Therefore, as illustrated in FIG. 4, when the holder main body 210 is in the lowered position h1, the plate-shaped members defining and functioning as the shield of the stopper 213 shield the ends of the winding core T placed on the roller 212, thus restricting movement of the winding core T in the winding core axial direction. When the holder main body 210 is in the raised position h2, the plate-shaped members defining and functioning as the shield expose the ends of the winding core T on the roller 212, thus releasing the restriction of movement of the winding core T in the winding core axial direction.

The pair of plate-shaped members are structured so as to diverge upwards. As a result, the entry for setting the winding core T is widened, making it easier to set the winding core T into the holder main body 210. When setting the winding core T, the position of the winding core T in the winding core axial direction is guided to be properly positioned within the holder main body 210. Once the winding core T is set in the holder main body 210, movement of the winding core T is restricted in the winding core axial direction.

Roll Holder

The roll holder 22 retrieves and holds the roll R, which is the green sheet film G wound into a roll by the winder 13 of the ceramic green sheet molding device 10. As illustrated in FIGS. 5 to 9, the roll holder 22 includes a roll lifter 221 and a holder main body 220.

Roll Lifter

The roll lifter 221 is designed to raise and lower the holder main body 220. For example, the roll lifter 221 of the present example embodiment includes a hydraulic mechanism (not illustrated) and a roll lifter that can be raised and lowered by the hydraulic mechanism. The roll lifter, similar to the winding core lifter, is provided within a hollow portion in the trolley 25*a* of the vehicle body 25 and is raised and lowered by the hydraulic mechanism. The drive source for the lifting mechanism is not limited to the hydraulic mechanism. An example of the drive source may be an electric motor.

Holder Main Body of Roll Holder

The surface of the holder main body 220 that holds the roll R is a curved surface that fits the size of the roll R to be retrieved. This curved surface is preferably slightly larger in curvature radius than the roll R to be retrieved. However, the surface of the holder main body 220 that holds the roll R is not limited to a curved surface. For example, the surface may include two inclined surfaces.

The holder main body 220 is, for example, made of stainless steel. However, the material of the holder main body 220 is not limited to stainless steel. The holder main body 220 is preferably made of a material with rigidity, and is preferably made of metal. The surface of the holder main body 220 may include rubber such as, for example, a urethane rubber sheet, placed over the surface made of metal such as stainless steel. In other words, the surface of the holder main body 220 may be made of rubber. This prevents direct contact between the roll and the metal surface, thus protecting the roll. The rubber layer also helps distribute pressure and absorb shocks when holding the roll.

The holder main body 220 can be raised and lowered. The roll lifter 221 position-controls the holder main body 220 between the lowered position H1 and the raised position H2. For instance, the lowered position H1 is the position of the holder main body 220 as illustrated in FIG. 7. The raised position H2 is the position of the holder main body 220 as illustrated in FIG. 7. The holder main body 220 may also include detectors such as, for example, proximity sensors or touch sensors to detect whether the roll R is held.

Detector to Detect Floor Obstacles

As illustrated in FIGS. 1, 5, 8, and 9, the automated guided vehicle 20 may include a floor obstacle detector 26 to detect the presence or absence of obstacles on the floor surface, over which the automated guided vehicle 20 travels. For convenience of description, illustrations of the floor obstacle detector 26 may be omitted in this specification. The floor obstacle detector 26 may be provided in one and the other directions along the travel direction of the automated guided vehicle 20. For example, the floor obstacle detector 26 may be provided at the front and the rear of the automated guided vehicle 20 in the travel direction.

The floor obstacle detector 26 may be a non-contact sensor, such as, for example, an image sensor, laser scanner, ultrasonic sensor, or other types of sensors. For example, when using a laser scanner, as illustrated in FIGS. 1 and 5, the reflected light of the laser light L2 being scanned and emitted is detected to identify the horizontal direction and detect obstacles on the floor.

Detector

The detector 23 acquires information on the roll holder passage region. In the present example embodiment, the detector 23 is a hanging sheet detector that detects the presence of a sheet HS hanging from the roll R. When winding the roll R, the end of the roll R may hang after completing the winding of the roll R. Therefore, if a sheet HS is hanging from the roll R when the automated guided vehicle 20 enters the winder 13 defining and functioning as the sheet winding device, the automated guided vehicle 20 may contact the hanging sheet HS, potentially causing issues such as damage to the roll.

More specifically, if the automated guided vehicle 20 enters the winder 13 while the film is hanging from the roll R set in the winder 13, the sheet HS hanging from the roll R may come into contact with the holder main body 220 or the roll lifter 221 of the roll holder 22 of the automated guided vehicle 20, potentially causing damage to the roll R.

If the automated guided vehicle 20 enters the winder 13 while the film is hanging from the roll R set in the winder 13, the sheet HS hanging from the roll R may get entangled in the wheels of the traveler 25*b* of the automated guided vehicle 20, potentially causing damage to the roll R.

If the automated guided vehicle 20 including the winding core holder 21 enters the winder 13 while the film is hanging from the roll R set in the winder 13, the winding core T held by the winding core holder 21 of the automated guided vehicle 20 may stick to the sheet hanging from the roll R, potentially causing damage to the roll R.

Therefore, the automated guided vehicle 20 of the present example embodiment includes the detector 23 that detects the presence of a sheet HS hanging from the roll R set in the winder 13. The automated guided vehicle controller 27, defining and functioning as the control device to be described later, controls the automated guided vehicle 20 to avoid contact with the hanging sheet HS if present.

Typically, the green sheet film G is molded onto the carrier film C, excluding the beginning and end of the roll R. Therefore, the beginning and end of the roll R solely include the carrier film C, without the green sheet film G molded. In the present example embodiment, the carrier film C is, for example, a translucent film. Thus, the sheet HS hanging from the roll R includes the translucent film.

As illustrated in FIG. 5, the detector 23 acquires information on the roll holder passage region R1, including the positions through which the roll holder 22 passes when the automated guided vehicle 20 travels. This enables the detector 23 to ensure that there are no obstacles along the path through which the roll holder 22 will pass.

In the present example embodiment, as illustrated in FIG. 5, the detector 23 acquires information on the winding core passage region R2, including the positions through which the winding core T held by the winding core holder 21 passes when the automated guided vehicle 20 travels. This enables the detector 23 to ensure that there are no obstacles along the path through which the winding core holder 21 will pass.

The detector 23 of the present example embodiment is, for example, an image sensor that acquires image information of at least either the roll holder passage region R1 or the winding core passage region R2. In the present example embodiment, the detector 23 acquires information on the roll holder passage region R1. The detector 23 acquires information on the winding core passage region R2.

The detector 23 in the present example embodiment acquires image information on the roll holder passage region R1 and the winding core passage region R2 at a plurality of times, corresponding to a plurality of timings of emitting illumination light L1 from the illuminator 24 described later.

The detector 23, which acquires information on at least either the roll holder passage region R1 or the winding core passage region R2, does not necessarily need to detect the presence or absence of obstacles on the floor surface near the automated guided vehicle 20. The detector 23 preferably acquires information on a detection area above the detection area of the floor obstacle detector 26 described above.

The detector preferably acquires information from an area broader than the detection area of the floor obstacle detector 26. More specifically, the detector preferably acquires information from an area that is vertically broader than the detection area of the floor obstacle detector. The detector 23 serving as the hanging sheet detector can detect the presence of a sheet HS hanging from the roll R, even if the sheet HS does not reach the floor.

Illuminator

The illuminator 24 is designed to improve the detection efficiency of the detector 23. As illustrated in FIG. 5, the illuminator 24 emits the illumination light L1 towards the roll holder passage region R1, including the positions through which the roll holder 22 passes when the automated guided vehicle 20 travels. The illuminator 24 emits the illumination light L1 towards the winding core passage region R2, including the positions through which the winding core T held by the winding core holder 21 passes when the automated guided vehicle 20 travels.

The illuminator 24 may be integrated with the detector 23. In the present example embodiment, the illuminator 24 emits flash light as the illumination light L1. In the present example embodiment, the illuminator 24 is controlled to emit a plurality of rounds of illumination light L1 at time intervals. For example, the illuminator 24 intermittently illuminates at intervals of one second or less during the period since the shutter 10*b* opens until the automated guided vehicle 20 reaches the roll retrieval position.

Vehicle Body

The vehicle body 25 includes the trolley 25*a* and the traveler 25*b*. The trolley 25*a* mounts various components of the automated guided vehicle 20. For example, the trolley 25*a* mounts the winding core holder 21, the roll holder 22, the detector 23, the illuminator 24, and the floor obstacle detector 26 to detect obstacles on the floor. The traveler 25*b* is designed to movably support the trolley 25*a*. The traveler 25*b* includes, for example, a plurality of wheels rotatably attached to the trolley 25*a*, and a driver that drives the wheels to rotate. The configuration of the traveler 25*b* is not limited to this.

Automated Guided Vehicle Controller

Next, an example of the automated guided vehicle controller 27 is described using FIG. 8. The automated guided vehicle controller 27 is designed to control various operations of the automated guided vehicle 20, such as roll retrieval operation, winding core setting operation, travel operation, and hanging film detection processing as described later. The automated guided vehicle controller 27 includes a processor and other components, and the processor executes computational processing to control various operations. As illustrated in FIG. 8, the automated guided vehicle controller 27 includes a processor 270, ROM 271, RAM 272, a bus 273, an input/output interface 274, an input 275, an output 276, a storage 277, a communicator 278, and a power supply 279. The configuration of the automated guided vehicle controller 27 is not limited to this.

The processor 270, for example, executes various processing such as computation and control, which are necessary for operating the automated guided vehicle controller 27. The processor 270 may be, for example, a CPU (Central Processing Unit), MPU (Micro Processing Unit), SoC (System on Chip), DSP (Digital Signal Processor), GPU (Graphics Processing Unit), ASIC (Application Specific Integrated Circuit), PLD (Programmable Logic Device), FPGA (Field-Programmable Gate Array), or a combination of these. The processor 270 may also be combined with hardware accelerators.

The processor 270 controls various units of the automated guided vehicle controller 27 to provide the functions, based on, for example, firmware, system software, and application software programs stored in the ROM 271 or the RAM 272. The processor 270 executes the processing described below based on these programs. A portion or all of the programs may be embedded in the circuitry of the processor 270.

The processor 270, the ROM 271, and the RAM 272 are interconnected via a bus 273. The bus 273 is also connected to the input/output interface 274. The input 275, the output 276, the storage 277, the communicator 278, and the power supply 279 are connected to the input/output interface 274.

The input 275 and the output 276 are user interfaces electrically connected in a wired or wireless manner to an input/output interface (not illustrated). The input 275 includes, for example, operation buttons on the automated guided vehicle 20. The output 276 includes devices such as a monitor 276*a* that displays images for the operation of the automated guided vehicle 20, and a speaker 276*b* that amplifies sounds such as warnings. The input 275 and the output 276 may be integrated into a single unit including both display and input functionalities, such as a touchscreen.

The storage 277 includes of primary storage devices including non-volatile memory such as, for example, ROM (Read Only Memory) or volatile memory such as RAM (Random Access Memory), and secondary storage devices including, for example, magnetic disks, optical disks, magneto-optical disks, or semiconductor memory. In the present example embodiment, the storage 277 stores delivery route information for the automated guided vehicle 20, audio data for outputting from the speaker 276*b* of the output 276, and various programs for execution by the controller 280.

The communicator 278 is a device that communicates wirelessly with other computers or devices using communication standards such as BLE (Bluetooth Low Energy) or Wi-Fi (Wireless Fidelity). However, communication is not limited to wireless communication. For instance, the communicator 278 may also perform wired communication with other computers or devices via a network cable.

The power supply 279 is a battery that supplies power to the automated guided vehicle 20. The power supply 279 may be a commonly used battery such as, for example, a lithium-ion secondary battery or may be a primary battery such as a dry-cell battery. The power supply 279 is not limited to batteries, and may also be connected to an external power source via a power cable to supply power to the automated guided vehicle 20.

Control Block

Next, the functional configuration of the automated guided vehicle controller 27 is described using FIG. 9. The controller 280, which performs various controls for the automated guided vehicle 20, is defined by a processor executing a program for computational processing. The controller 280 of the present example embodiment includes an input controller 281, an output controller 282, a communication controller 283, a delivery management device 284, an illumination controller 285, an information acquirer 286, a determinator 287, a travel controller 288, a notifier 289, a winding core holder lifting controller 290, and a roll holder lifting controller 291.

The input controller 281 executes processing of the inputs on the input 275 by administrators or similar personnel of the automated guided vehicle 20. For example, the input controller 281 executes processing of the operation to turn on the power of the automated guided vehicle 20 performed by administrators or similar personnel.

The output controller 282 executes processing of displaying images on the monitor 276*a* of the output 276. For example, the output controller 282 executes processing of the operations to output the operation menu screen for operating the automated guided vehicle 20 on the monitor 276*a*.

The communication controller 283 executes processing of communication with external devices through the communication unit 278. For example, the communication controller 283 executes processing of receiving delivery instruction information for the rolls R and the winding cores T as transmitted from the controller 30 through the communication unit 278.

The delivery management device 284 executes processing of the operation to manage delivery of the rolls R and other items by the automated guided vehicle 20.

The illumination controller 285 controls the drive of the illuminator 24. For instance, the illumination controller 285 controls the illuminator 24 to emit a plurality of rounds of the illumination light L1 while the shutter 10*b* of the ceramic green sheet molding device 10 is open.

The information acquirer 286 acquires information acquired by the detector 23. The information acquirer 286 may acquire information detected by the floor obstacle detector 26.

The determinator 287 determines the presence or absence of a translucent film hanging from the roll R set in the winder 13, based on the information acquired by the information acquisition unit 286. For example, when executing the hanging film detection processing as described later, the determinator 287 in the controller 280 determines the presence or absence of a translucent film sheet HS hanging from the roll R set in the winder 13, based on information of at least either the roll holder passage region R1 or the winding core passage region R2 as acquired by the detector 23.

In the present example embodiment, the determinator 287 determines the presence or absence of a translucent film sheet HS hanging from the roll R, based on information of the roll holder passage region R1 as acquired by the detector 23. The determinator 287 determines the presence or absence of a translucent film sheet HS hanging from the roll R, based on information of the winding core passage region R2 as acquired by the detector 23. Details on the hanging film detection processing will be described later.

The travel controller 288 executes roll delivery control, roll retrieval preparation control, winding core setting preparation control, and hanging film detection processing.

The roll delivery controller controlling the traveler 25*b* to travel along a predefined route. For example, rails may be laid along the predefined route, and the automated guided vehicle 20 may travel along the rails.

Figure 15:
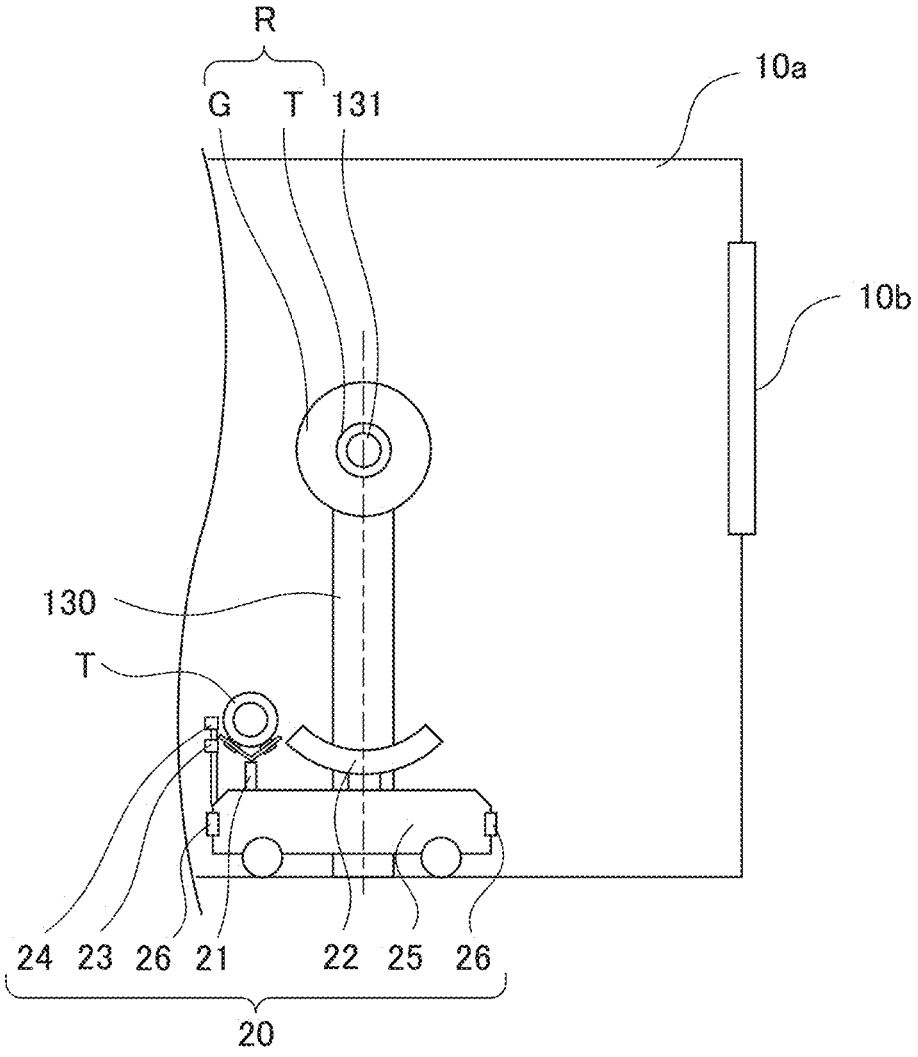
FIG. 15 is a schematic diagram illustrating a first half of a roll retrieval operation included in the winding core setting step of FIG. 14.
Figure 17:
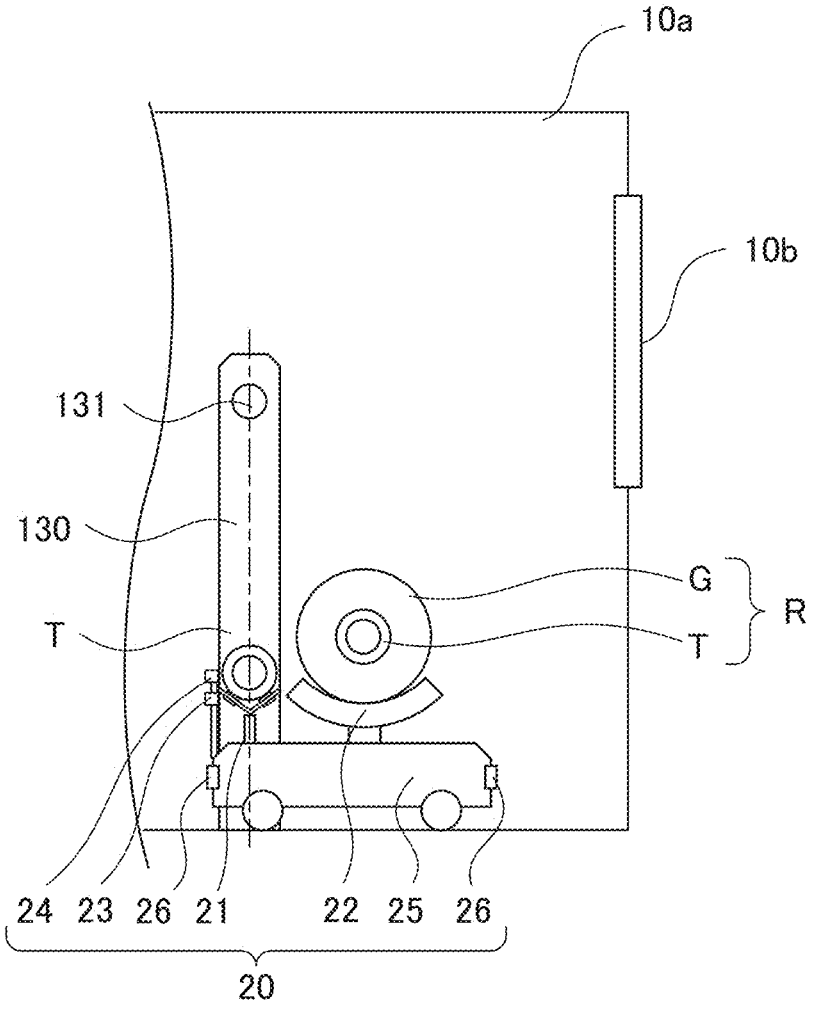
FIG. 17 is a schematic diagram illustrating a first half of the winding core setting operation included in the winding core setting step of FIG. 14.

As illustrated in FIG. 15, the roll retrieval preparation control involves controlling the traveler 25*b* to move the holder main body 220 of the roll holder 22 to a roll retrieval position below the winding shaft 131*a*. As illustrated in FIG. 17, the winding core setting preparation control involves controlling the traveler 25*b* to move the holder main body 210 of the winding core holder 21 to a winding core setting position below the winding shaft 131*a*. Sensors may be provided at predefined intervals on the rails, allowing the controller 280 to find out the position of the automated guided vehicle 20.

During the hanging film detection processing, when determining that there is a translucent film hanging from the roll R set in the winder 13, the travel control unit 288 controls the automated guided vehicle 20 to stop. For example, the traveler 25*b* of the automated guided vehicle 20 is controlled to stop driving.

In the case of determining that there is a translucent film sheet HS hanging from the roll set in the winder 13, the notifier 289 issues a notification. For instance, in the case of determining that there is a sheet HS hanging from the roll R set in the winder 13, the notifier 289 causes the speaker 276*b* of the output unit 276 to beep.

The winding core holder lifting controller 290 controls the operation of the lifter 211 of the winding core holder 21. For example, as coordinated under the winding core setting preparation control by the travel controller 288, at the timing when the holder main body 210 of the winding core holder 21 has moved to a winding core setting position below the winding shaft 131*a*, the holder main body 210 of the winding core holder 21 is raised to the raised position h2.

The roll holder lifting controller 291 controls the operation of the roll lifter 221 of the roll holder 22. For example, as coordinated under the roll retrieval preparation control by the travel controller 288, at the timing when the holder main body 220 of the roll holder 22 has moved to a roll retrieval position below the winding shaft 131*a*, the holder main body 220 of the roll holder 22 is raised to the raised position H2.

Controller

Next, an example of the controller 30 is described using FIG. 10. FIG. 10 is a block diagram illustrating the hardware configuration of the ceramic green sheet molding device according to the present example embodiment. Detailed descriptions of components that are common or similar to those already discussed may be omitted and referred to by the same names.

The controller 30 is designed to control various operations for manufacturing the rolls R of the green sheet film G in the manufacturing system S and delivering the rolls R to subsequent processes. The controller 30 includes a processor and other components, and the processor executes computational processing through the processor to control various operations. As illustrated in FIG. 10, the controller 30 includes a processor 300, ROM 301, RAM 302, a bus 303, an input/output interface 304, an input 305, an output 306, a storage 307, a communicator 308, and a power supply 309. The configuration of the controller 30 is not limited to this.

Control Block

Figure 11:
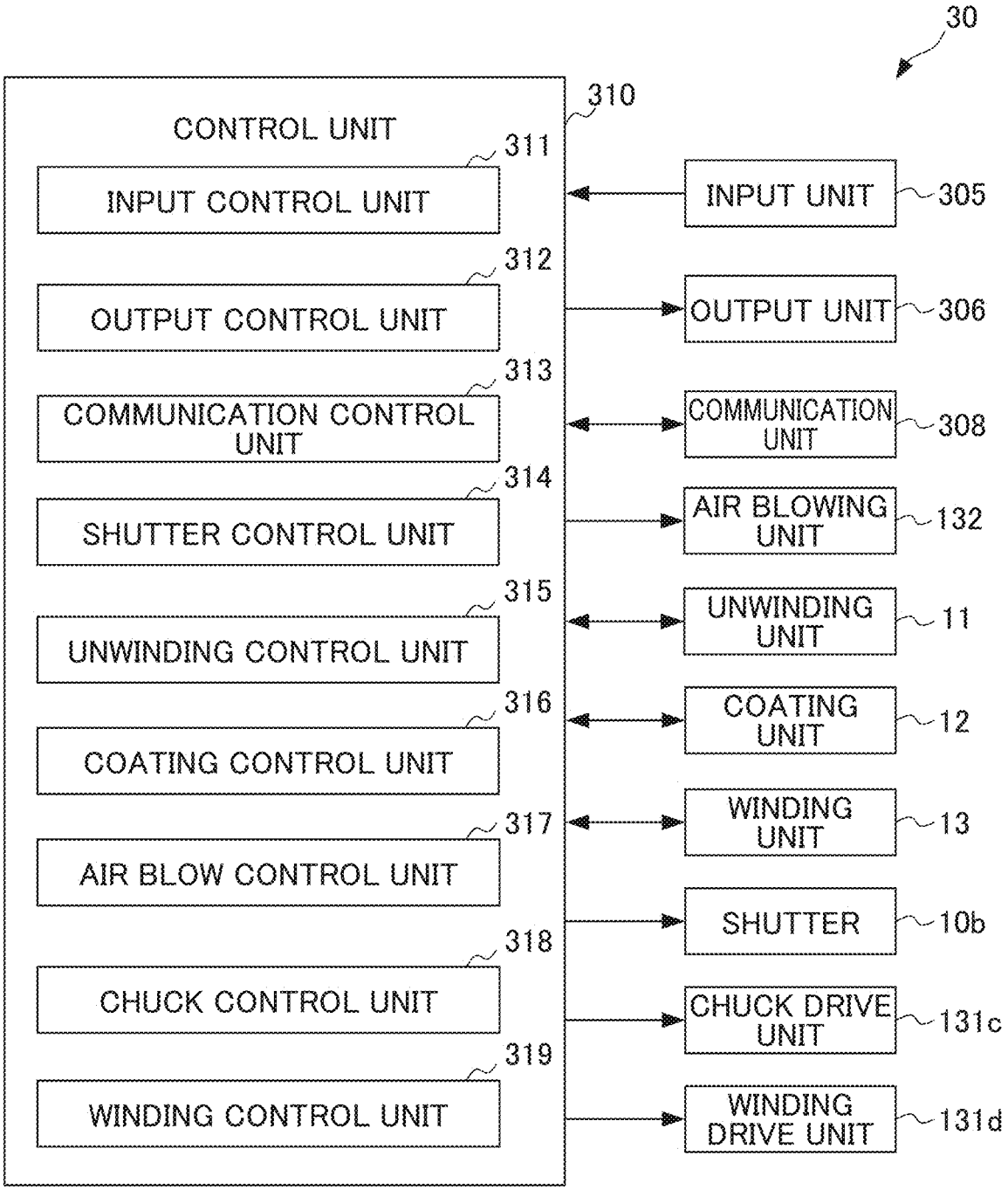
FIG. 11 is a block diagram illustrating the functional configuration of a controller according to an example embodiment of the present invention.

Next, the functional configuration of the controller 30 is described using FIG. 11. FIG. 11 is a block diagram illustrating the functional configuration of the controller according to the present example embodiment. Detailed descriptions of components that are common or similar to those already discussed may be omitted and referred to by the same names. The controller 310, which performs various controls for the manufacturing system S, is implemented by executing computational processing on a processor running programs. The controller 310 in the present example embodiment includes an input controller 311, an output controller 312, a communication controller 313, a shutter controller 314, an unwinding controller 315, a coating controller 316, an air blow controller 317, a chuck controller 318, and a winding controller 319.

The shutter controller 314 controls the opening and closing of the shutter 10*b* of the ceramic green sheet molding device 10. For example, the shutter controller 314 executes processing to raise or lower the shutter 10*b* to move between an open position where the shutter 10*b* is open and a closed position where the shutter 10*b* is closed. The shutter controller 314 may open the shutter 10*b* at the timing when the automated guided vehicle 20 has got in proximity to the shutter 10*b*. The proximity of the automated guided vehicle 20 to the shutter 10*b* can be detected using known methods. The proximity of the automated guided vehicle 20 may be detected using, for example, sensors such as proximity sensors.

Alternatively, the shutter controller 314 may open the shutter 10*b* at the timing of receiving a command to open the shutter 10*b* from the automated guided vehicle 20. In this case, at the timing of getting in proximity to the shutter 10*b*, the automated guided vehicle 20 may send a command to open the shutter 10*b* to the controller 30.

The unwinding controller 315 executes various controls for the unwinder 11. For example, the unwinding controller 315 controls the unwinder 11 to chuck the roll Rc of the carrier film C. The control by the unwinding controller 315 for chucking the roll Rc is similar to the control by the chuck controller 318 for chucking the roll R, thus the description thereof is omitted.

The coating controller 316 performs various controls for the coater 12. For instance, the coating controller 316 controls the coater 12 to coat a slurry including a ceramic material on the carrier film C, and controls the drying section (not illustrated) to perform drying operation.

The air blow controller 317 controls the air blower 132 to perform air blow operation. For example, during the winding operation by the winder 13 to wind the green sheet film G molded on the carrier film C into a roll, the air blow controller 317 controls the air blower 132 to perform air blow operation. The control of the air blow operation is not limited to this.

The chuck controller 318 controls the chucking device 131 to perform chucking operation. For example, the chuck controller 318 controls the chucking operation when the winding core T is not chucked by the chucking device 131. In this case, the chuck controller 318 verifies whether the holder main body 210, which holds the winding core T, of the winding core holder 21 of the automated guided vehicle 20 has moved to the raised position h2. The chuck controller 318 starts the chucking operation to move the pair of winding shafts 131*a* to the chucking position where the winding core T is chucked at the timing when the holder main body 210 has moved to the raised position h2.

The chuck controller 318 controls the chucking operation in the state where the chucking device 131 has chucked the wound roll R. In this case, the chuck controller 318 verifies whether the holder main body 220 of the roll holder 22 of the automated guided vehicle 20 has moved to the raised position H2. The chuck controller 318 starts the chucking operation to move the pair of winding shafts 131*a* to the chuck releasing position where the roll R is chucked at the timing when the holder main body 220 has moved to the raised position H2.

Known techniques can be used as a method to detect whether the holder main body 210 of the winding core holder 21 of the automated guided vehicle 20 has moved to the raised position h2, or whether the holder main body 220 of the roll holder 22 has moved to the raised position H2. For example, photoelectric sensors may be provided on each of the pair of supports 130. In this case, blocking the light between the photoelectric sensors may lead to determination that the holder main body 210 of the winding core holder 21 has moved to the raised position h2, or that the holder main body 220 of the roll holder 22 has moved to the raised position H2.

The winding controller 319 executes various controls for the winder 13. For example, the winding controller 319 controls the winder 13 to perform winding operation for winding the green sheet film G molded on the carrier film C into a roll. The winding operation as controlled by the winding controller 319 is coordinated with the control of the unwinding operation by the unwinding controller 315 and the control of the coating and drying operations by the coating control unit 316.

Roll Manufacturing Steps

Figure 12:
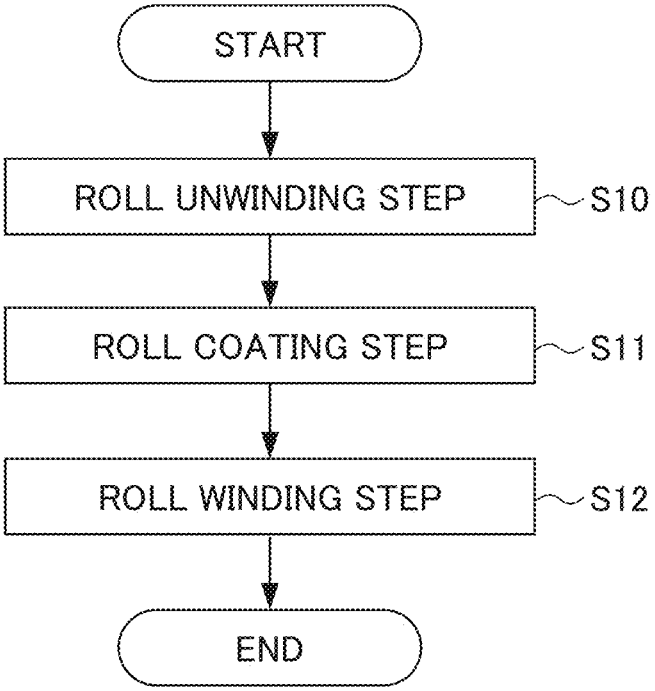
FIG. 12 is a flowchart illustrating the flow of roll manufacturing steps according to an example embodiment of the present invention.

Next, an example of roll manufacturing steps executed by the manufacturing system S according to an example embodiment of the present invention are described using FIG. 12. FIG. 12 is a flowchart illustrating the flow of the roll manufacturing steps according to the present example embodiment. The roll manufacturing steps include a roll unwinding step (Step S10), a roll coating step (Step S11), and a roll winding step (Step S12).

The roll unwinding step (Step S10) is the step of unwinding the roll of the carrier film C and supplying the carrier film C to the coater.

The roll coating step (Step S11) is the step of applying a slurry including a ceramic material onto the carrier film C and molding a ceramic green sheet on the carrier film C. In the roll coating step (Step S11), the ceramic green sheet molded on the carrier film C may be dried.

The roll winding step (Step S12) is the step of winding the green sheet film G into a roll and retrieving the roll.

Roll Winding Step

Figure 13:
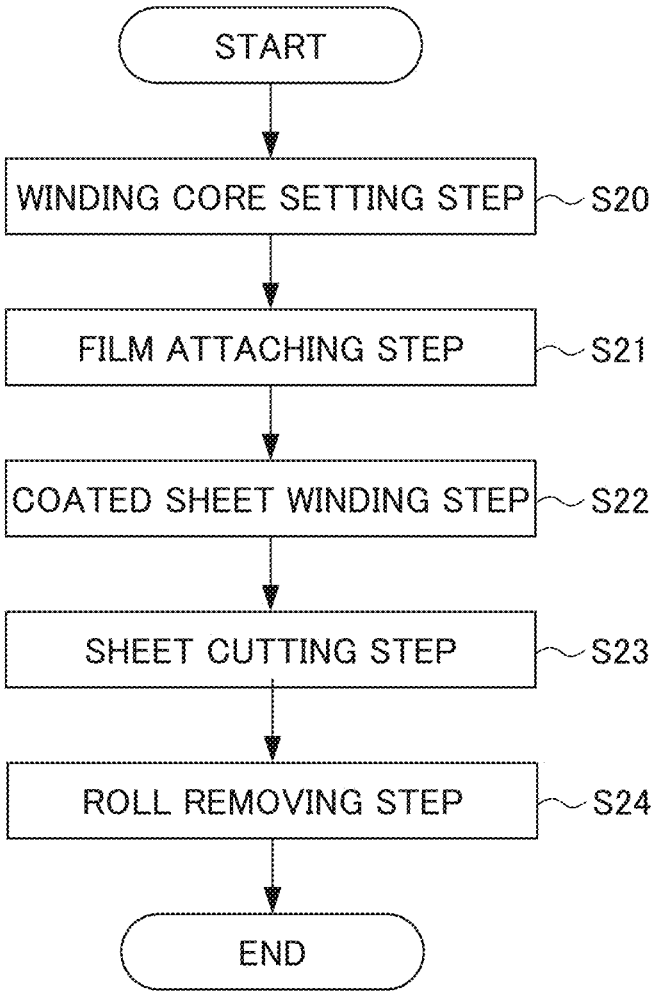
FIG. 13 is a flowchart illustrating the flow of a roll winding step included in the roll manufacturing steps illustrated in FIG. 12.

Next, the roll winding step of winding the green sheet film G onto the winding core T set in the winder 13 to form the roll R is described using FIG. 13. FIG. 13 is a flowchart illustrating the flow of the roll winding step included in the roll manufacturing steps described in FIG. 12. The roll winding step (Step S12) executed by the manufacturing system S includes the winding core setting step (Step S20), the film attaching step (Step S21), the coated sheet winding step (Step S22), the sheet cutting step (Step S23), and the roll removing step (Step S24).

In the present example embodiment, when the roll winding step (Step S12) is executed consecutively, the roll removing step (Step S24) of the previous roll winding step (Step S12) and the winding core setting step (Step S20) of the subsequent roll winding step (Step S12) are executed consecutively. Details will be described later.

The winding core setting step (Step S20) is the step of setting the winding core T on the winding shaft 131*a*. Details will be described later.

The film attaching step (Step S21) is the step of attaching the end face of the carrier film C to the winding core T set on the winding shaft 131*a*. The film may be attached manually or by a machine designed to attach the film.

The coated sheet winding step (Step S22) is the step of winding the coated sheet onto the winding core T set on the winding shaft 131*a*. For example, the winding controller 319 controls the winding driver 131*d* to rotate the winding shaft 131*a*, and to wind the coated sheet onto the winding core T set on the winding shaft 131*a*.

The sheet cutting step (Step S23) is the step of cutting the sheet of the carrier film C to complete the roll. Since one end of the carrier film C is adhered to the winding core of the roll Rc, once a certain amount of the carrier film C is wound to form the roll R, the roll R is connected to the roll Rc via the carrier film C. Therefore, the sheet is cut in order to detach the sheet of the carrier film C from the winding core of the roll Rc. The sheet may be cut manually or by a machine designed to cut the sheet.

The roll removing step (Step S24) is the step of removing the roll R from the winding shaft 131*a*. Details will be described later.

After completing the removal of the roll R, the controller 30 opens the shutter 10*b*, and the automated guided vehicle 20 delivers the roll R along a designated route to a warehouse or similar location. Subsequently, the controller 30 controls the shutter 10*b* to be closed. The winder 13 may include an auto reel change function.

Next, when the roll winding step (Step S12) is executed consecutively, the roll removing step (Step S24) of the previous roll winding step (Step S12) and the winding core setting step (Step S20) of the subsequent roll winding step (Step S12) are executed consecutively, which will be described in detail using FIGS. 14 to 18.

Figure 14:
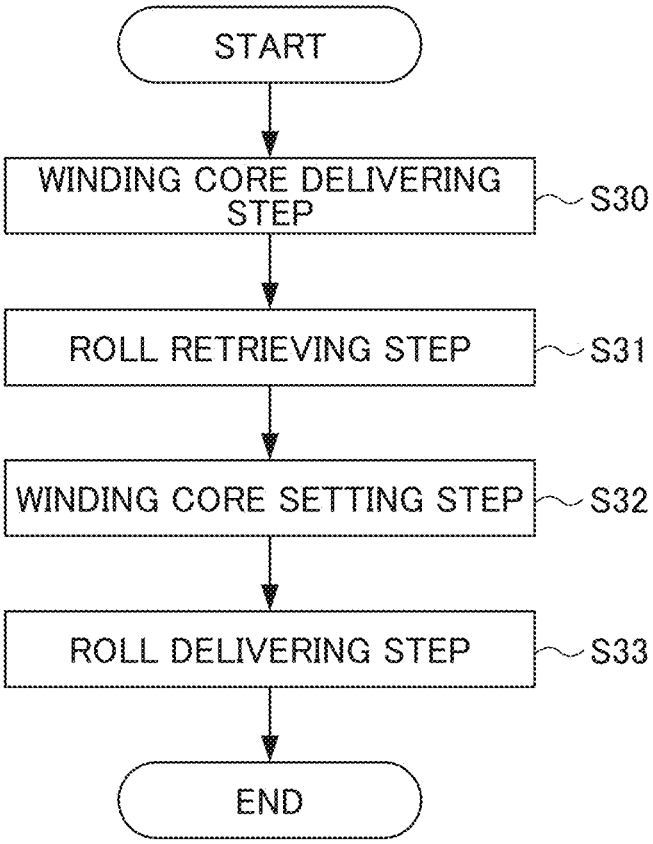
FIG. 14 is a flowchart illustrating the flow of a roll removing step and a winding core setting steps when consecutively performing the roll winding step of FIG. 13.
Figure 16:
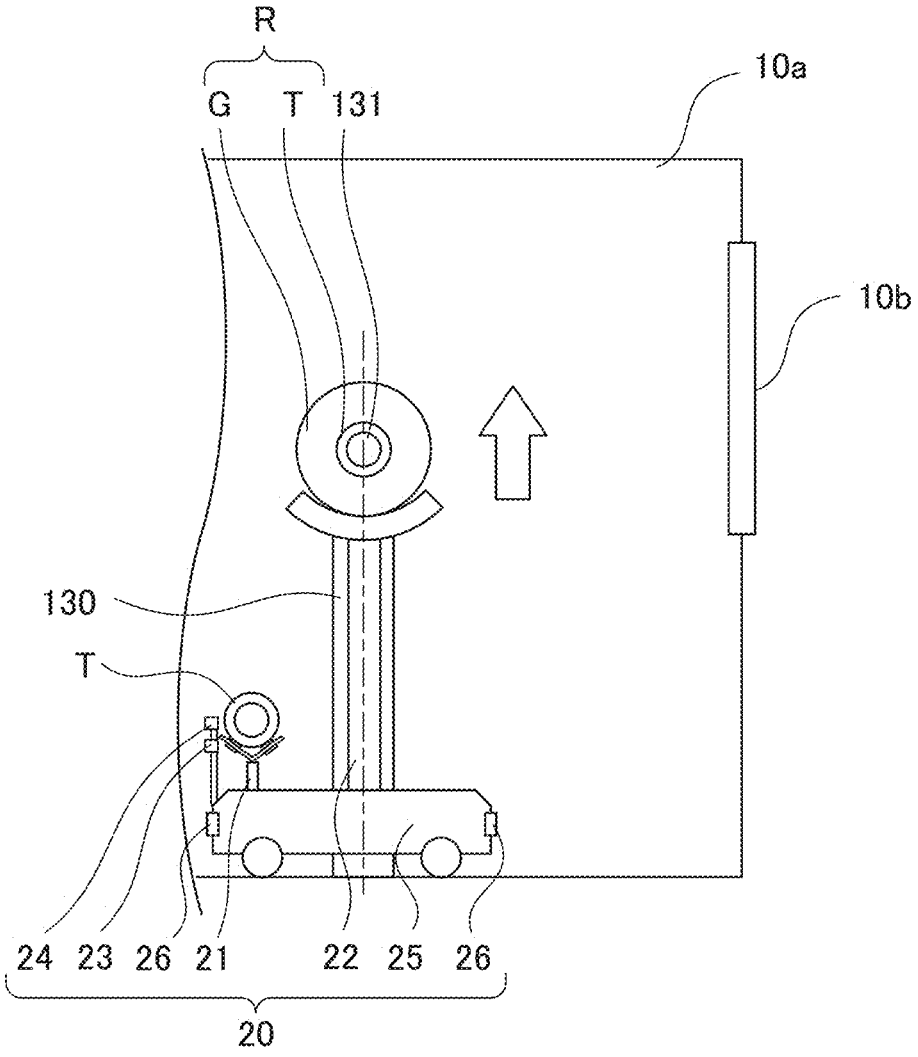
FIG. 16 is a schematic diagram illustrating a second half of the roll retrieval operation included in the winding core setting step of FIG. 14.
Figure 18:
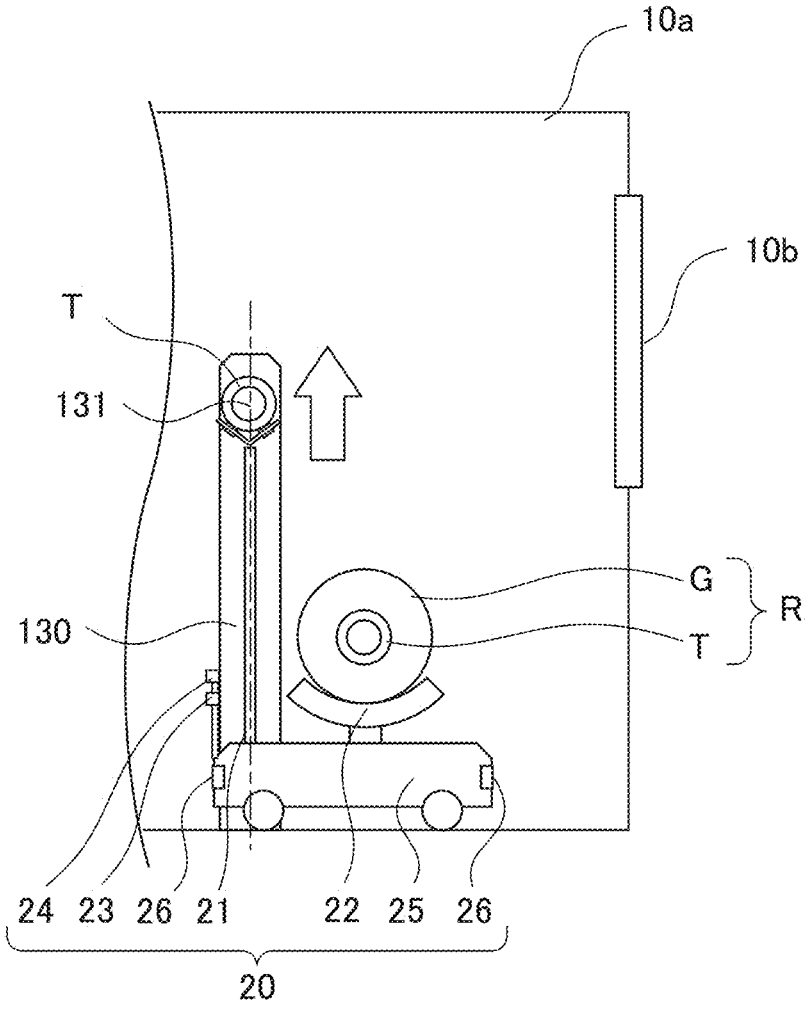
FIG. 18 is a schematic diagram illustrating the second half of the winding core setting operation included in the winding core setting step of FIG. 14.

FIG. 14 is a flowchart illustrating the flow of the roll removing step and the winding core setting step when the roll winding step in FIG. 13 is executed consecutively. FIG. 15 is a schematic diagram illustrating the first half of the roll retrieving operation included in the winding core setting step of FIG. 14. FIG. 16 is a schematic diagram illustrating the second half of the roll retrieving operation included in the winding core setting step of FIG. 14. FIG. 17 is a schematic diagram illustrating the first half of the winding core setting operation included in the winding core setting step of FIG. 14. FIG. 18 is a schematic diagram illustrating the second half of the winding core setting operation included in the winding core setting step of FIG. 14.

The roll removing step (Step S24) and the winding core setting step (Step S20), when executed consecutively, include the winding core delivering step (Step S30), the roll retrieving step (Step S31), the winding core setting step (Step S32), and the roll delivering step (Step S33).

In the winding core delivering step (Step S30), the automated guided vehicle 20 moves to the winder 13 while delivering the winding core T. For instance, when the automated guided vehicle 20 receives a call command transmitted from the controller 30, the travel controller 288 controls the traveler 25*b* to move along a predetermined route to the front of the shutter 10*b* of the ceramic green sheet molding device 10.

First, the shutter controller 314, for example, opens the shutter 10*b* of the ceramic green sheet molding device 10. Specifically, the controller 30 uses a proximity sensor (not illustrated) to determine whether the automated guided vehicle 20 is in proximity, and when determining that the automated guided vehicle 20 is in proximity, the controller 30 controls the shutter 10*b* to move to the open position. For instance, when the proximity sensor (not illustrated) detects an object in proximity, the controller 30 may control the shutter 10*b* to move to the open position if the automated guided vehicle 20 is being called, or may control the shutter 10*b* to remain in the closed position if the automated guided vehicle 20 is not being called.

Once the shutter 10*b* is open, the automated guided vehicle 20 moves inside. When the entire automated guided vehicle 20 has moved inside the housing 10*a*, the controller may control the shutter 10*b* to move to the closed position.

The roll retrieving step (Step S31) is the step of retrieving the roll R, on which the green sheet film G has been wound. The automated guided vehicle 20, once inside the ceramic green sheet molding device 10, moves to the roll retrieval position as illustrated in FIG. 15. For example, the travel controller 288 controls the traveler 25*b* to travel to the roll retrieval position.

Next, the automated guided vehicle 20 having moved to the roll retrieval position raises the roll holder from the lowered position H1 to the raised position H2. Specifically, as illustrated in FIG. 16, the roll holder lifting controller 291 controls the roll lifter 221 to raise the holder main body 220 of the roll holder 22 from the lowered position H1 to the raised position H2.

Once the holder main body 220 of the roll holder 22 reaches the raised position H2, the controller 30 controls the chucking device 131 of the winder 13 to release the roll R from chucking. Specifically, once a sensor (not illustrated) detects that the holder main body 220 has reached the raised position H2, the chuck controller 318 controls the chuck driver 131*c* to slide so as to widen the distance between the pair of winding shafts 131*a*, thus releasing the winding core T from chucking, completing the roll removal.

Next, the automated guided vehicle 20 lowers the roll holder from the raised position H2 to the lowered position H1. Specifically, the roll holder lifting controller 291 controls the roll lifter 221 to lower the holder main body 220 of the roll holder 22 from the raised position H2 to the lowered position H1.

Subsequently, the winding core setting step (Step S32) begins. In the winding core setting step (Step S32), the automated guided vehicle 20 sets the winding core. First, the automated guided vehicle 20 moves to the winding core setting position. For example, the travel controller 288 controls the automated guided vehicle 20 to deliver the winding core, and controls the traveler 25*b* to travel to the winding core setting position as illustrated in FIG. 17.

Next, the automated guided vehicle 20 having moved to the winding core setting position raises the holder main body 210 of the winding core holder 21 from the lowered position h1 to the raised position h2. Specifically, as illustrated in FIG. 18, the winding core holder lifting controller 290 controls the lifter 211 to raise the holder main body 210 of the winding core holder 21 from the lowered position h1 to the raised position h2.

Next, at the timing when the holder main body 210 has reached the raised position h2, the controller 30 controls the winder 13 to chuck the winding core T. Specifically, when a sensor (not illustrated) detects that the holder main body 210 has reached the raised position h2, the chuck controller 318 controls the chuck driver 131*c* to slide the pair of winding shafts 131*a* from the chuck releasing position to the chucking position. The pair of winding shafts 131*a* narrow the gap therebetween to chuck the winding core T, thus completing the winding core setting.

Subsequently, the winding core holder lifting controller 290 lowers the holder main body 210 of the winding core holder 21 from the raised position h2 to the lowered position h1. Specifically, as illustrated in FIG. 18, the winding core holder lifting controller 290 controls the lifter 211 to lower the holder main body 210 of the winding core holder 21 from the raised position h2 to the lowered position h1.

In the roll delivering step (Step S33), the automated guided vehicle 20 moves to a warehouse (not illustrated) or the next step while delivering the roll. The controller 30 controls the shutter 10*b* to move to the open position. Next, the automated guided vehicle 20 travels along a predetermined route to the warehouse (not illustrated) or the next step, performing the predetermined delivery operations. When the entire automated guided vehicle 20 has exited the housing, the controller controls the shutter 10*b* to move to the closed position.

Hanging Sheet Detection Processing

As mentioned above, the end of the roll R may hang after the roll R has finished winding, and the automated guided vehicle 20 may contact the hanging sheet HS, potentially causing issues such as damage to the roll. Therefore, in the present example embodiment of the manufacturing system S, the detector 23 executes the hanging sheet detection processing to detect a hanging sheet, and takes actions such as stopping the automated guided vehicle 20, thus preventing the automated guided vehicle 20 from contacting the hanging sheet HS.

The hanging sheet detection processing executed by the automated guided vehicle 20 is described below using FIG.

Figure 19:
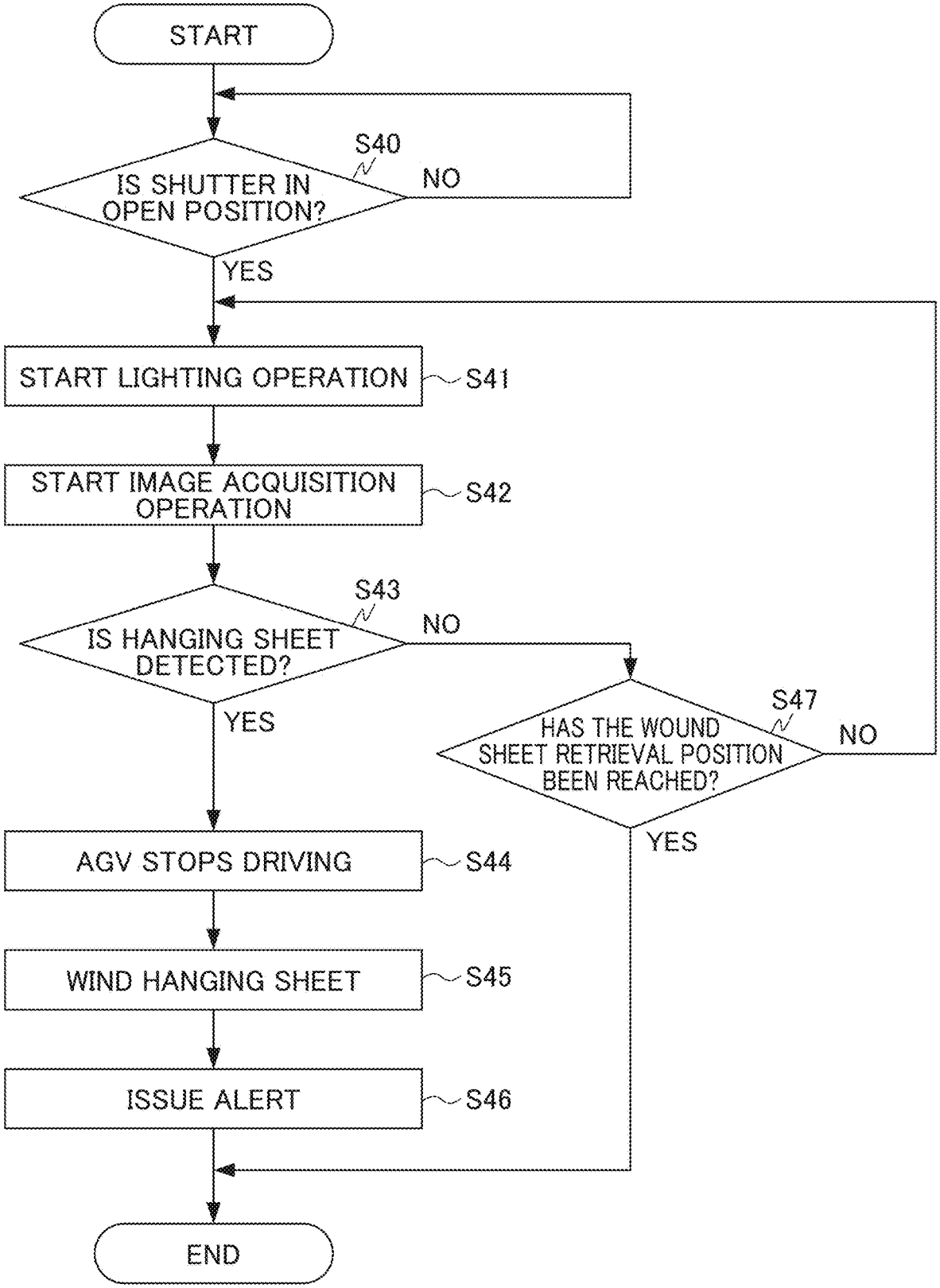
FIG. 19 is a flowchart illustrating the flow of a hanging film detection process according to an example embodiment of the present invention.

19. FIG. 19 is a flowchart illustrating the flow of the hanging sheet detection processing according to the present example embodiment.

First, the controller 280 checks whether the shutter 10*b* has moved to the open position (Step S40). If the shutter 10*b* has not moved to the open position (Step S40: NO), the controller 280 repeats the processing until the shutter 10*b* moves to the open position. On the other hand, if the shutter 10*b* has moved to the open position (Step S40: YES), the illumination controller 285 of the controller 30 controls the illuminator 24 of the automated guided vehicle 20 to start the lighting operation (Step S41). That is, the illumination controller 285 controls the illuminator 24 to emit a plurality of flashes of illumination light L1 while the shutter 10*b* of the ceramic green sheet molding device 10 is open.

Next, the information acquirer 286 starts acquiring image information on at least one of the roll holder passage region R1 or the winding core passage region R2 from the detector 23 at the plurality of timings, corresponding to the plurality of timings of emitting illumination light L1 emitted by the illuminator 24 (Step S42).

Subsequently, based on the image information on at least one of the roll holder passage region R1 or the winding core passage region R2 as acquired by the information acquirer 286 at the plurality of timings while the shutter 10*b* of the winder 13 was open, the determinator 287 determines the presence or absence of a translucent film sheet HS hanging from the set roll R set in the winder 13 (Step S43).

In the case of having determined that there is no sheet HS hanging from the roll R set in the winder 13 (Step S43: NO), the controller 280 checks whether the automated guided vehicle 20 has reached the wound sheet retrieval position serving as the roll retrieval position (Step S47). If the automated guided vehicle 20 has not reached the wound sheet retrieval position serving as the roll retrieval position (Step S47: NO), the processing returns to Step S41 and repeats checking whether there is a sheet HS hanging from the roll, until the automated guided vehicle 20 reaches the wound sheet retrieval position serving as the roll retrieval position. If the automated guided vehicle 20 has reached the wound sheet retrieval position serving as the roll retrieval position (Step S47: YES), the controller 280 terminates the hanging sheet detection processing.

In the case of having determined that there is a sheet HS hanging from the roll R set in the winder 13 (Step S43: YES), the travel controller 288 controls the traveler 25*b* of the automated guided vehicle to stop driving (Step S44). After the traveler 25*b* of the automated guided vehicle stops driving, the hanging sheet HS is wound onto the roll (Step S45). The operator may manually wind the hanging sheet HS onto the roll R, or the controller 30 may control the winder 13 to automatically wind the hanging sheet HS onto the roll R.

In the case of having determined that there is a sheet HS hanging from the roll R set in the winder 13, the notifier 289 issues a notification, for example, using the speaker 276*b* of the output 276 (Step S46). The notification may prompt the automated guided vehicle 20 to stop driving, or may prompt the operator to wind the hanging sheet HS onto the roll R.

Here, the detector 23 acquires image information in order to detect the hanging sheet HS. For example, as illustrated in FIG. 20, the detector 23 detects light reflected from the hanging sheet HS in order to detect the hanging sheet HS.

Figure 20:
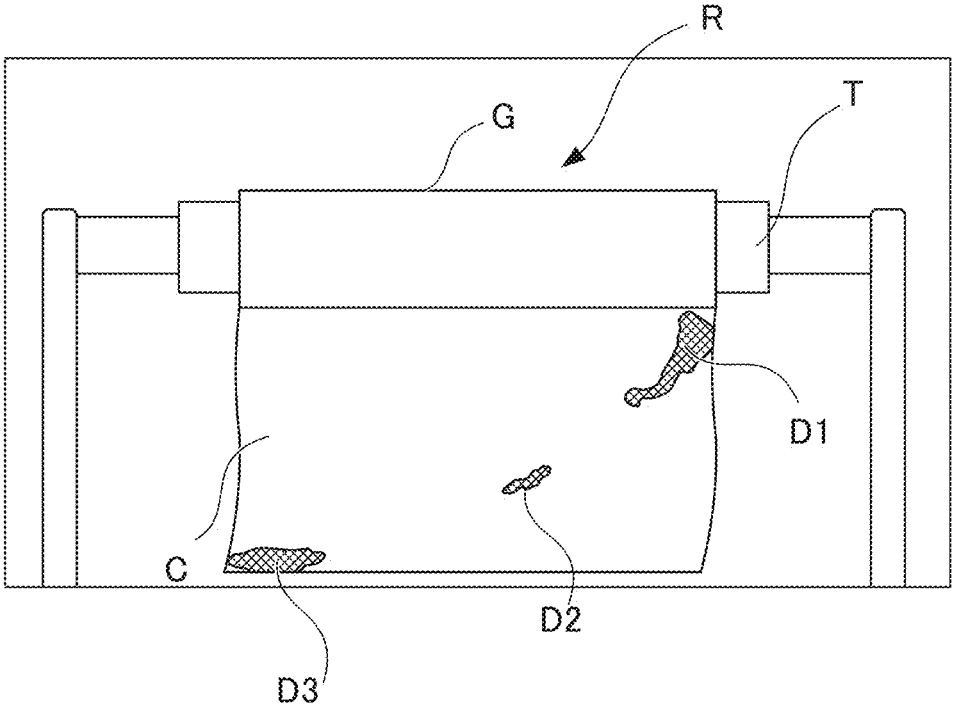
FIG. 20 is a schematic diagram illustrating a hanging film detection method according to an example embodiment of the present invention.

FIG. 20 is a schematic diagram illustrating the hanging film detection method according to the present example embodiment. More specifically, FIG. 20 illustrates an image detected by the detector 23 of the automated guided vehicle 20 when entering inside the housing 10*a* of the winder 13 in order to deliver the winding core T and retrieve the roll R. The carrier film C hanging from the roll R is a translucent film, which is transparent and typically allows the coater 12 and others to be seen through it, which is omitted in FIG. 20 for simplicity. FIG. 20 illustrates reflecting portions D1, D2, and D3. The reflecting portions D1, D2, and D3 are portions where the illumination light L1 emitted by the illuminator 24 of the automated guided vehicle 20 is reflected.

As described above, the roll R is the green sheet film G molded on the carrier film C, onto which a slurry including a ceramic material is applied, and which is wound around the winding core T. However, the slurry is not applied to the end of the elongated carrier film C, which is difficult to detect using image information, since the detection target of detector 23 is a translucent film.

However, the present example embodiment facilitates detection, since the determination is based on the plurality of images corresponding to the plurality of timings of emitting the illumination light L1. The illumination light L1 emitted by the illuminator 24 is, for example, preferably flash light, and the detector 23 detects the presence of a translucent film by acquiring images indicating the flash light reflected on the translucent film. In other words, the detector 23 can acquire images including the reflecting portions D1, D2, and D3 as illustrated in FIG. 20, and can determine the presence of the sheet HS, which is the carrier film C hanging from the roll R, based on the presence of the reflecting portions D1, D2, and D3.

The images acquired by the detector 23 can be stored in a storage device or displayed on a monitor of any device on the network N. This configuration allows for monitoring the status of the automated guided vehicle 20 or analyzing the causes of stoppage.

In the present example embodiment, when a hanging sheet HS is detected in at least one of the plurality of images corresponding to the plurality of timings of emitting the illumination light L1, it is determined that there is a sheet HS hanging from the roll R set in the winder 13. The presence of the hanging sheet HS may be determined based on the difference between a plurality of pieces of image information. For example, the determinator 287 may perform noise removal or binarization processing on two pieces of image information, acquire a difference therebetween, and determine that there is a sheet HS hanging from the roll R if the difference exists over a predetermined area or greater.

Furthermore, in the present example embodiment, when the translucent film is hanging from the roll R set on the winding shaft 131*a* of the winder 13, the air blower 132 of the winder 13 blows air such that the hanging translucent film sheet HS will flutter. As a result, the hanging sheet HS flutters or tilts to be destabilized, making it easier to detect the translucent film in one of the plurality of images corresponding to the plurality of timings of emitting the illumination light L1.

Figure 21:
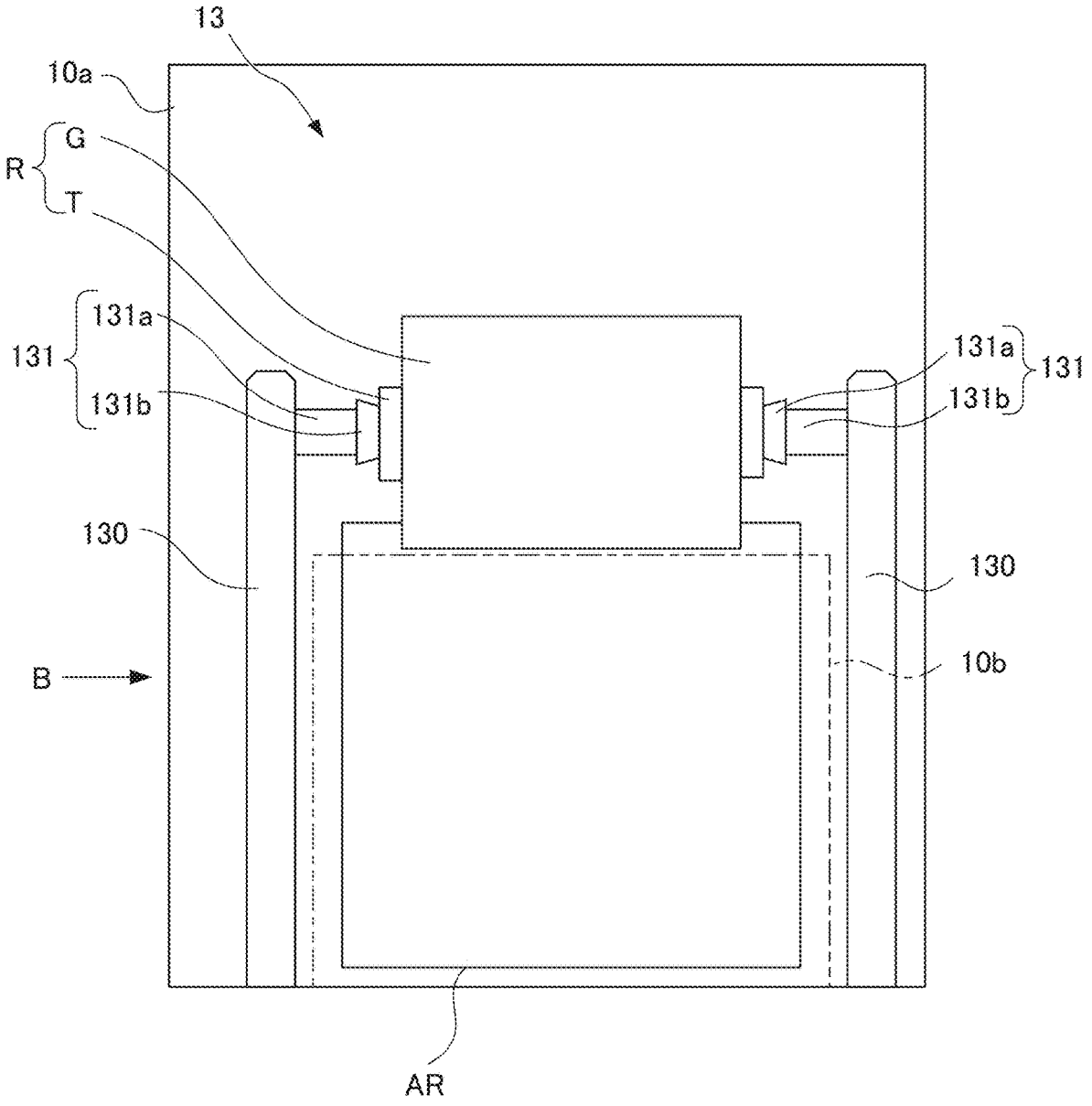
FIG. 21 is a schematic diagram illustrating a modified example of an example embodiment of the present invention, corresponding to FIG. 2.
Figure 22:
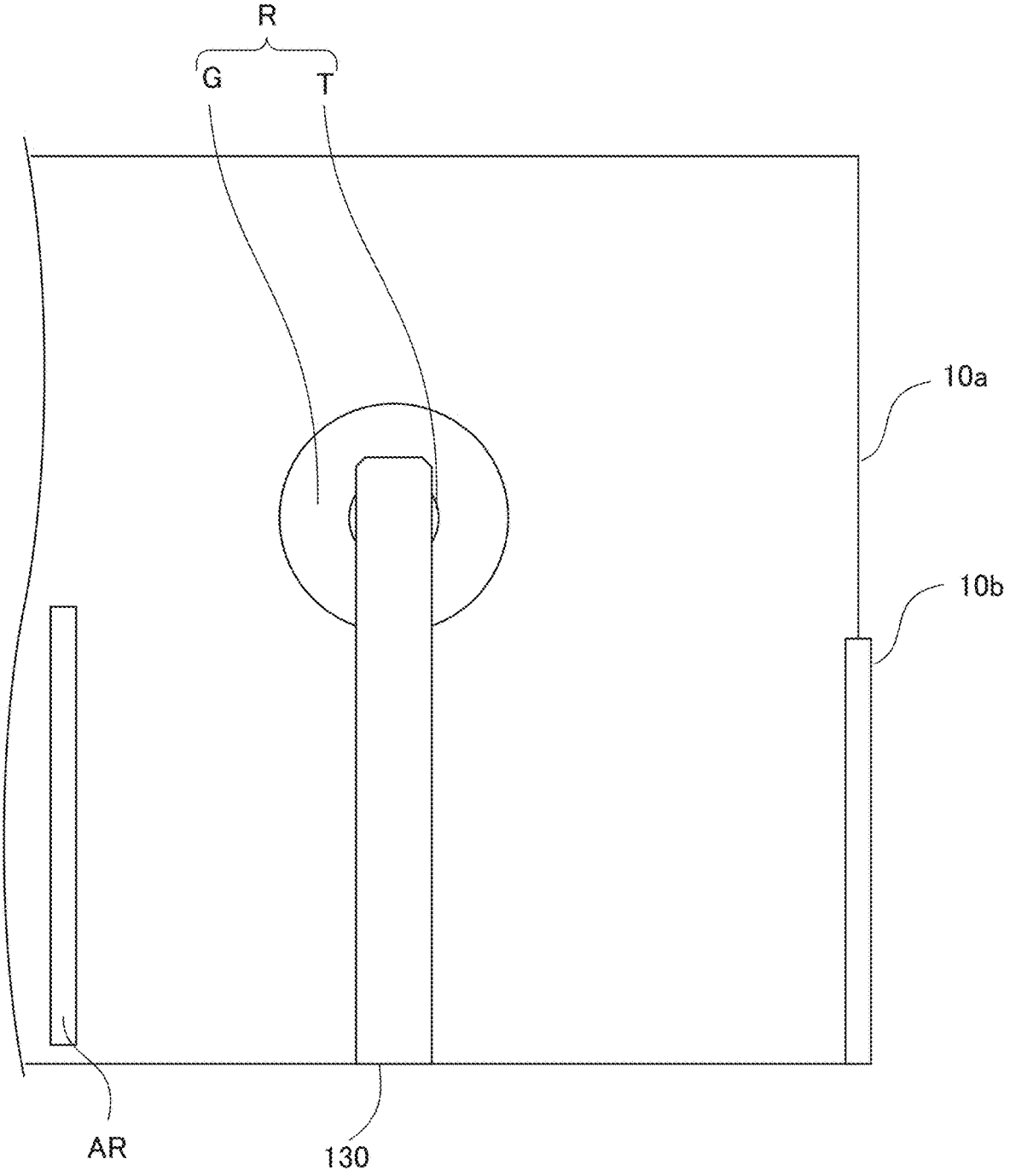
FIG. 22 is a schematic diagram of the winding core holder, as viewed from the side in FIG. 21.

Additionally, the winder 13 may include an anti-reflection cover AR, as illustrated in FIGS. 21 and 22. FIG. 21 is a schematic diagram illustrating a modified example of an example embodiment of the present invention, corresponding to FIG. 2. FIG. 22 is a schematic diagram of the winding core holder, as viewed from the side in FIG. 21.

The anti-reflection cover AR is designed to assist in detecting a sheet HS hanging from the roll R, and may be a plate-shaped member with an anti-reflective surface, for example. When the illuminator 24 emits a flash light, reflections may occur from objects positioned further behind the roll R of the winder 13 inside the device, in addition to the sheet HS hanging from the roll R. In such cases, there is a risk of false detections by the detector 23 of the automated guided vehicle 20.

As illustrated in FIG. 22, the anti-reflection cover AR is positioned further behind the support 130 inside the device, in order to reduce or prevent reflections from objects positioned further behind the roll R of the winder 13 inside the device. More specifically, the anti-reflection cover AR is positioned outside the range through which the automated guided vehicle 20 moves when retrieving the roll R.

As illustrated in FIG. 21, the dimension of the anti-reflection cover AR in the height direction is preferably greater than the distance from the floor to the lower end of the roll R set on the winding shaft 131*a*. The width of the anti-reflection cover AR is preferably greater than the width of the roll R set on the winding shaft 131*a* in the width direction. By setting the dimensions of the anti-reflection cover AR as described, the hanging sheet HS can be more distinctly identified.

By incorporating the anti-reflection cover AR, the manufacturing system S can prevent reflections from objects located behind the roll R of the winder 13 when the illuminator 24 of the automated guided vehicle 20 emits the illumination light L1. This prevents false detections by the detector 23 of the automated guided vehicle 20, and more clearly identifies the hanging sheet HS, thus more reliably preventing damage to the roll, such as when the winding core is supplied to the sheet winding device.

As configured above, the automated guided vehicle 20 can achieve the following advantageous effects.

As described earlier, the trailing end of the roll may hang down after the roll has finished winding. If the automated guided vehicle enters the sheet winding device while the film is hanging from the roll set in the sheet winding device, for example, the sheet hanging from the roll may contact the holder main body or the lifting mechanism of the roll holder of the automated guided vehicle, potentially causing damage to the roll.

If the automated guided vehicle enters the sheet winding device while the film is hanging from the roll set in the sheet winding device, the hanging sheet HS may get entangled in the wheels of the automated guided vehicle, potentially causing damage to the roll.

If the automated guided vehicle including the winding core holder enters the sheet winding device while the film is hanging from the roll set in the sheet winding device, the winding core held by the winding core holder of the automated guided vehicle may stick to the film hanging from the roll, potentially causing damage to the roll.

Conventionally, there are automated guided vehicles including a floor obstacle detector to detect the presence of obstacles on the floor, over which the automated guided vehicle travels. However, such floor obstacle detectors do not acquire information on the roll holder passage region including the positions through which the roll holder passes, making it difficult to detect sheets HS hanging from the roll.

Typically, molding of the ceramic green sheet onto the carrier film excludes the beginning and end of the roll R. Therefore, the beginning and end of the roll solely include the carrier film, without the ceramic green sheet molded. Furthermore, when the carrier film is made of translucent film, detecting this translucent sheet hanging from the roll with optical methods is even more challenging.

With the automated guided vehicle of the present example embodiment, a sheet HS hanging from the roll can be properly detected, even if the sheet is a translucent film. However, the sheet to be detected is not limited to a translucent sheet. The sheet may be a non-translucent sheet. For example, the sheet may be a ceramic green sheet molded on a non-translucent carrier film.

The automated guided vehicle 20 according to the present example embodiment includes the roll holder 22 that holds the roll R, the detector 23 that acquires information on the roll holder passage region R1, including the positions through which the roll holder 22 passes when the automated guided vehicle 20 travels, and the illuminator 24 that emits illumination light L1 towards the roll holder passage region R1.

Thus, the automated guided vehicle of the present example embodiment can prevent situations where the roll gets damaged, such as when the automated guided vehicle 20 enters the winder 13 serving as the sheet winding device.

The automated guided vehicle 20 of the present example embodiment further includes the winding core holder 21 that holds the winding core T with an adhesive surface. The detector 23 acquires information on the winding core passage region R2, including the positions through which the winding core T held by the winding core holder 21 passes when the automated guided vehicle 20 travels. The illuminator 24 emits illumination light L1 towards the winding core passage region R2.

Therefore, the automated guided vehicle 20 of the present example embodiment can prevent situations where the roll R gets damaged due to contact of the hanging sheet HS with the adhesive surface of the winding core T, such as when the winding core T is supplied to the winder 13 serving as a sheet winding device.

In the present example embodiment of the automated guided vehicle 20, the detector 23 is an image sensor that acquires image information of the roll holder passage region R1.

This enables determining the presence or absence of a sheet HS hanging from the roll R, based on the image information, enabling more accurate detection of the hanging sheet HS, thus more reliably preventing situations where the roll R gets damaged, such as when the automated guided vehicle 20 enters the winder 13.

In the present example embodiment of the automated guided vehicle 20, the detector 23 is an image sensor that acquires image information of the winding core passage region R2.

This enables determining the presence or absence of a sheet HS hanging from the roll R, based on the image information, enabling more accurate detection of the hanging sheet HS, thus preventing situations where the roll R gets damaged due to contact of the hanging sheet HS with the adhesive surface of the winding core T, such as when the automated guided vehicle 20 enters the winder 13.

In the present example embodiment of the automated guided vehicle 20, the illumination light L1 emitted by the illuminator 24 is flash light.

Flash light makes it easier to detect reflections from the sheet HS hanging from the roll R, thus more reliably preventing situations where the roll R gets damaged, such as when the automated guided vehicle 20 enters the winder 13.

The automated guided vehicle 20 according to the present example embodiment retrieves and delivers a roll from the winder 13, and the detector 23 detects the presence of a sheet HS hanging from the roll R set in the winder 13.

This more reliably prevents situations where the roll R gets damaged, even when retrieving the roll R set in the winder 13.

The automated guided vehicle 20 of the present example embodiment delivers the winding core T to the winder 13, and the detector 23 detects the presence of a sheet HS hanging from the roll R set in the winder 13.

This more reliably prevents situations where the roll R gets damaged, even when delivering the winding core T to the winder 13.

The manufacturing system S of the present example embodiment further includes the floor obstacle detector 26 that detects the presence or absence of obstacles on the floor surface ahead of the automated guided vehicle 20.

As a result, if there are obstacles on the floor, the obstacles can be detected and managed with the floor obstacle detector 26. Meanwhile, if a sheet HS is hanging, the detector 23 defining and functioning as a hanging sheet detector can prevent situations where the roll gets damaged, such as when the automated guided vehicle 20 enters the winder 13.

The manufacturing system S of the present example embodiment includes the automated guided vehicle 20, the winder 13 that manufactures the roll R by winding the green sheet film G, the automated guided vehicle controller 27, and controller 30. The automated guided vehicle controller 27 determines the presence or absence of a sheet HS hanging from the roll R set in the winder 13, based on the information on the roll holder passage region R1 acquired by the detector 23.

This prevents situations where the roll R gets damaged, such as when the automated guided vehicle 20 enters the winder 13.

In the present example embodiment of the manufacturing system S, the illuminator 24 emits a plurality of flashes of illumination light L1 at time intervals, and the detector 23 acquires information on the roll holder passage region R1 at the plurality of timings, corresponding to the plurality of timings of emitting the illumination light L1. The automated guided vehicle controller 27 determines the presence or absence of a sheet HS hanging from the roll R set in the winder 13, based on the information on the roll holder passage region R1 at the plurality of timings.

This allows the detector 23 to determine the presence or absence of a sheet HS hanging from the roll R a plurality of times, thus more reliably preventing situations where the roll R gets damaged, such as when the automated guided vehicle moves near the winder 13 to retrieve the roll R.

In the present example embodiment of the manufacturing system S, the illuminator 24 emits a plurality of flashes of illumination light L1 at time intervals, and the detector 23 acquires information on at least one of the roll holder passage region R1 and the winding core passage region R2 at the plurality of timings, corresponding to the plurality of timings of emitting illumination light L1. The automated guided vehicle controller 27 determines the presence or absence of a sheet HS hanging from the roll R set in the winder 13, based on the information on the roll holder passage region R1 at the plurality of timings.

This allows the detector 23 to determine the presence or absence of a sheet HS hanging from the roll R a plurality of times, thus more reliably preventing situations where the roll R gets damaged, such as when the automated guided vehicle 20 enters the winder 13.

In the present example embodiment of the manufacturing system S, in the case of determining that there is a sheet HS hanging from the roll R set in the winder 13, the automated guided vehicle controller 27 controls the automated guided vehicle 20 to stop.

This allows the automated guided vehicle 20 to automatically stop when the detector 23 determines a plurality of times that there is a sheet HS hanging from the roll R, thus more reliably preventing situations where the roll gets damaged.

The manufacturing system S of the present example embodiment includes the air blower 132 that blows air W when a sheet HS is hanging from the roll R set in the winder 13 such that the hanging sheet HS will flutter.

This makes it easier for the illumination light L1 from the illuminator 24 to reflect off the fluttering sheet HS, allowing the detector 23 to more reliably detect the sheet HS hanging from the roll R, thus preventing situations where the roll R gets damaged.

The manufacturing system S of the present example embodiment includes the shutter 10*b* that blocks the entry of the automated guided vehicle 20. The automated guided vehicle controller 27 determines the presence or absence of a sheet HS hanging from the roll R set in the winder 13, based on the information on the roll holder passage region R1 acquired by the detector 23 when the shutter 10*b* was open.

Thus, example embodiments of the present invention is also effective for a structure that encloses the winder 13, such as the housing 10*a* including the shutter 10*b*. For example, inside the housing 10*a* including the shutter 10*b*, the detector 23 can acquire information on the roll holder passage region R1 when the shutter 10*b* is open.

In the present example embodiment of the manufacturing system S, the illuminator 24 emits a plurality of flashes of illumination light L1 while the shutter 10*b* is open.

As a result, such as when the automated guided vehicle 20 enters the winder 13 inside the housing 10*a* including the shutter 10*b*, the detector 23 determines the presence or absence of a hanging sheet HS a plurality of times, thus more reliably preventing situations where the roll R gets damaged.

The manufacturing system S of the present example embodiment includes the shutter 10*b* that blocks the entry of the automated guided vehicle 20. The automated guided vehicle controller 27 determines the presence or absence of a sheet HS hanging from the roll R set in the winder 13, based on the information on the winding core passage region R2 acquired by the detector 23 when the shutter 10*b* was open.

This allows for more reliably preventing situations where the roll R gets damaged, such as when the automated guided vehicle 20 enters the winder 13 inside the housing 10*a* including the shutter 10*b*.

The present example embodiment of the manufacturing system S includes the automated guided vehicle 20, the automated guided vehicle controller 27, and the controller 30. The automated guided vehicle controller 27 determines the presence or absence of a sheet HS hanging from the roll R set in the winder 13, based on the information on the winding core passage region R2 acquired by the detector 23.

This prevents situations where the roll R gets damaged, such as when the automated guided vehicle 20 supplies the winding core T to the winder 13.

The automated guided vehicle 20 of the present example embodiment includes the winding core holder 21 that holds the winding core T with an adhesive surface, the detector 23 that acquires information on the winding core passage region R2, including the positions through which the winding core T held by the winding core holder 21 passes when the automated guided vehicle 20 travels, and the illuminator 24 that emits illumination light L1 towards the winding core passage region R2.

Thus, the automated guided vehicle 20 of the present example embodiment can prevent situations where the roll R gets damaged, such as when the winding core T is supplied to the winder 13.

Other Modifications

The controller of the manufacturing system S including the automated guided vehicle 20 have been described as the controllers 280 and 310 in the example embodiments above. However, this is not limiting. For example, the controllers of the manufacturing system S including the automated guided vehicle 20 may be distributed between the automated guided vehicle controller 27 and the controller 30, or may be partially or entirely hosted on a server or similar device on a network. Even when the controllers are distributed, if they are functionally cooperating with the functions of the automated guided vehicle 20, they can essentially be considered as the controller 280 of the automated guided vehicle 20. Even when the controllers are distributed, if they are functionally cooperating with the functions of the manufacturing system S, they can essentially be considered as the controller 310 of the manufacturing system S.

The present invention is not restricted to the configurations described in the example embodiments above and can be modified and applied within the scope that does not alter the essence of the invention. Combinations of two or more desirable configurations described in the example embodiments are also considered as the present invention.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An automated guided vehicle, comprising:

a roll holder to hold a roll;

a detector to acquire information on a roll holder passage region that includes positions through which the roll holder passes when the automated guided vehicle travels; and an illuminator to emit illumination light in a direction along the roll holder passage region.

2. The automated guided vehicle according to claim 1, further comprising:

a winding core holder to hold a winding core including an adhesive surface; wherein the detector is operable to acquire information on a winding core passage region that includes positions through which the winding core held by the winding core holder passes when the automated guided vehicle travels; and the illuminator is operable to emit illumination light toward the winding core passage region.

3. The automated guided vehicle according to claim 2, wherein the detector is an image sensor to acquire image information on the winding core passage region.

4. The automated guided vehicle according to claim 2, wherein the automated guided vehicle is operable to deliver a winding core to a sheet winding device; and the detector is operable to detect a presence of a sheet hanging from the roll set in the sheet winding device.

5. A manufacturing system, comprising:

the automated guided vehicle according to claim 2;

a sheet winding device to manufacture a roll by winding a sheet; and a controller configured or programmed to determine a presence or an absence of a sheet hanging from a roll set in a sheet winding device, based on information on the winding core passage region as acquired by the detector.

6. The manufacturing system according to claim 5, wherein the illuminator is operable to emit a plurality of flashes of illumination light at time intervals;

the detector is operable to acquire information on the winding core passage region at a plurality of timings, corresponding to a plurality of timings of emitting the illumination light; and the controller is configured or programmed to determine the presence or absence of a sheet hanging from the roll set in the sheet winding device, based on the information on the winding core passage region at time intervals.

7. The manufacturing system according to claim 5, wherein the controller is configured or programmed to control the automated guided vehicle to stop, in a case of determining that there is a sheet hanging from the roll set in the sheet winding device.

8. The manufacturing system according to claim 5, further comprising:

an air blower; wherein when a sheet is hanging from the roll set in the sheet winding device, the air blower blows air to cause the sheet hanging to flutter.

9. The manufacturing system according to claim 5, further comprising:

a shutter to block entry of the automated guided vehicle; wherein the controller is configured or programmed to determine the presence or absence of a sheet hanging from the roll set in the sheet winding device, based on information on the winding core passage region as acquired by the detector when the shutter was open.

10. The manufacturing system according to claim 9, wherein the illuminator is operable to emit a plurality of flashes of illumination light while the shutter is open.

11. The automated guided vehicle according to claim 1, wherein the detector is an image sensor to acquire image information on the roll holder passage region.

12. The automated guided vehicle according to claim 1, wherein the illumination light emitted by the illuminator is a flash light.

13. The automated guided vehicle according to claim 1, wherein the automated guided vehicle is operable to retrieve and deliver a roll from a sheet winding device; and the detector is operable to detect a presence of a sheet hanging from the roll set in the sheet winding device.

14. The automated guided vehicle according to claim 1, further comprising a floor obstacle detector to detect a presence or an absence of an obstacle on a floor ahead of the automated guided vehicle.

15. A manufacturing system, comprising:

the automated guided vehicle according to claim 1;

a sheet winding device to manufacture a roll by winding a sheet; and a controller configured or programmed to determine a presence or an absence of a sheet hanging from a roll set in the sheet winding device, based on information on the roll holder passage region as acquired by the detector.

16. The manufacturing system according to claim 15, wherein the illuminator is operable to emit a plurality of flashes of illumination light at time intervals;

the detector is operable to acquire information on the roll holder passage region at a plurality of timings, corresponding to a plurality of timings of emitting the illumination light; and the controller is configured or programmed to determine the presence or absence of a sheet hanging from the roll set in the sheet winding device, based on the information on the roll holder passage region at the plurality of timings.

17. The manufacturing system according to claim 15, wherein the controller is configured or programmed to control the automated guided vehicle to stop, in a case of determining that there is a sheet hanging from the roll set in the sheet winding device.

18. The manufacturing system according to claim 15, further comprising:

an air blower; wherein when a sheet is hanging from the roll set in the sheet winding device, the air blower blows air to cause the sheet hanging to flutter.

19. The manufacturing system according to claim 15, further comprising:

a shutter to block entry of the automated guided vehicle; wherein the controller is configured or programmed to determine the presence or absence of a sheet hanging from the roll set in the sheet winding device, based on information on the roll holder passage region as acquired by the detector when the shutter was open.

20. The manufacturing system according to claim 19, wherein the illuminator is operable to emit a plurality of flashes of illumination light while the shutter is open.

21. An automated guided vehicle, comprising:

a winding core holder to hold a winding core including an adhesive surface;

a detector to acquire information on a winding core passage region which includes positions through which the winding core held by the winding core holder passes when the automated guided vehicle travels; and an illuminator to emit illumination light towards the winding core passage region.

* * * * *